US007912384B2

(12) United States Patent
Dan

(10) Patent No.: US 7,912,384 B2
(45) Date of Patent: Mar. 22, 2011

(54) IMAGE FORMING DEVICE ADJUSTING CONVEYING GAP BETWEEN CONSECUTIVELY FED SHEETS

(75) Inventor: Kenichi Dan, Nagoya (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 148 days.

(21) Appl. No.: 11/482,897

(22) Filed: Jul. 10, 2006

(65) Prior Publication Data

US 2007/0019971 A1 Jan. 25, 2007

(30) Foreign Application Priority Data

Jul. 22, 2005 (JP) ..... 2005-213220

(51) Int. Cl.
*G03G 15/00* (2006.01)

(52) U.S. Cl. ..... 399/16; 399/389; 399/396; 271/3.15; 271/3.16; 271/4.02; 271/121; 271/124; 271/125; 271/262; 271/265.04

(58) Field of Classification Search ..... 399/389, 399/396, 16; 271/3.15, 3.16, 4.02, 121, 124, 271/125, 262, 265.04
See application file for complete search history.

(56) References Cited

U.S. PATENT DOCUMENTS

| | | | | |
|---|---|---|---|---|
| 6,002,906 | A * | 12/1999 | Hino et al. | 399/303 |
| 6,231,041 | B1 * | 5/2001 | Jacques | 271/121 |
| 2004/0251608 | A1 * | 12/2004 | Saito et al. | 271/220 |

FOREIGN PATENT DOCUMENTS

| | | | |
|---|---|---|---|
| JP | 61081333 | | 4/1986 |
| JP | 11049388 | | 2/1999 |
| JP | 2001-310842 | A | 11/2001 |
| JP | 2001-354337 | A | 12/2001 |
| JP | 2003-095461 | A | 4/2003 |
| JP | 2003223022 | | 8/2003 |
| JP | 2003-312894 | A | 11/2003 |

OTHER PUBLICATIONS

JP Office Action dtd Jan. 12, 2010, JP Appln. 2005-213220, English translation.

* cited by examiner

*Primary Examiner* — Judy Nguyen
*Assistant Examiner* — Andy L Pham
(74) *Attorney, Agent, or Firm* — Banner & Witcoff, Ltd

(57) ABSTRACT

A laser printer forms images on a recording sheet fed from a paper cassette. A conveying gap between consecutively fed recording sheets is adjusted such that a conveying gap between consecutively fed thin sheets is larger than a conveying gap between consecutively fed thick sheets.

17 Claims, 12 Drawing Sheets

| TYPE OF RECORDING SHEET | CONVEYING GAP |
|---|---|
| NORMAL PAPER | REFERENCE VALUE + 30 msec |
| THICK PAPER | REFERENCE VALUE + 0 msec |
| THIN PAPER | REFERENCE VALUE + 60 msec |
| TRANSPARENCY | REFERENCE VALUE + 30 msec |

IMAGE FORMING DEVICE ADJUSTING CONVEYING GAP BETWEEN CONSECUTIVELY FED SHEETS

CROSS REFERENCE TO RELATED APPLICATIONS

This application claims priority from Japanese Patent Application No. 2005-213220 filed Jul. 22, 2005. The entire content of each of these priority applications is incorporated herein by reference.

TECHNICAL FIELD

The disclosure relates to an image forming device, such as a laser printer and a copier machine.

BACKGROUND

In an image-forming process performed in a conventional image-forming device such as a laser printer, a paper-feeding means feeds a sheet of recording medium to a conveying means, and the conveying means conveys the sheet between a transfer roller and a photosensitive drum where a toner image is transferred onto the sheet of recording medium. Subsequently, the toner is heated and melted as the sheet passes between a heating roller and a pressure roller, thereby fixing the toner image to the sheet of recording medium. In order to allocate sufficient time for developing print data and to prevent paper jams when feeding sheets of the recording medium consecutively, the image-forming device opens a prescribed gap (30 mm, for example) between a preceding sheet and a succeeding sheet. Further, since the frictional resistance against the sheet of recording medium on a conveying path differs based on the sheet thickness, this difference will cause a slight variance in the conveying speed and the pressure applied by the pressure roller. Hence, in order to form images of uniform quality on the recording medium, conventional image-forming devices adjust various image-forming conditions, such as the developing bias, transfer bias, and fixing temperature, based on the thickness of the sheet, as disclosed in Japanese unexamined patent application publications Nos. 2003-223022 and HEI-11-49388.

As shown in FIG. 12, a conventional image-forming device typically has a sheet sensor 202 for detecting the trailing edge of a sheet 201 that is fed by a feeding means (not shown) and conveyed by a conveying means (not shown). When the sheets 201 of recording medium are fed consecutively, the sheet sensor 202 detects the trailing edges of the sheets 201, and the image-forming device adjusts the gap between conveyed sheets 201 by controlling the timing at which each sheet 201 is fed from the feeding means to the conveying means based on the detection results.

The sheet sensor 202 is disposed downstream of the feeding means. In order to keep costs down, the sheet sensor 202 includes an actuator 203 and a detector 204. The actuator 203 is capable of pivoting in a direction indicated by arrows N in FIG. 12 and has a front end that protrudes into a conveying path of the sheet 201. The detector 204 is for detecting the rear end of the actuator 203. When the sheet 201 contacts the front end of the actuator 203, the actuator 203 pivots clockwise in FIG. 12. At this time, the detector 204 switches from an OFF state to an ON state, effectively detecting the leading edge of the sheet 201. After the sheet 201 passes over the actuator 203, the actuator 203 returns to its original position by pivoting counterclockwise in FIG. 12. At this time, the detector 204 changes from the ON state to the OFF state, effectively detecting the trailing edge of the sheet 201.

An image forming device further includes a fixing device having a heating roller and a pressure roller. When the heating roller and the pressure roller apply heat and pressure to the sheet 201 in order to fix an image on the sheet 201, the sheet 201 curls. There is a possibility that the curled sheet 201 may cause a paper jam by catching on some component in the image-forming device while being conveyed from the image-forming position to a discharge position. To resolve this problem, the image-forming device is provided with a discharge sensor having the same structure as the sheet sensor 202 described above disposed between the image-forming position and the discharge position in order to monitor the conveyed state of the sheet 201 based on the ON/OFF state of the discharge sensor.

SUMMARY

In the conventional image forming device described above, despite opening a prescribed gap (30 mm, for example) between successively conveyed sheets of recording medium, paper jams still frequently occur in conventional image-forming devices. After studying this problem, the inventors of the invention discovered that thin sheets of recording medium lacking body are more likely to cause jams. As they investigated the cause, the inventors determined that the paper jams occurred due to the relationship between the sheet sensor and the sheet thickness of the recording medium. The cause of this problem is described in more detail with reference to FIGS. 13 through 15.

A thin sheet 201 (such as a thin sheet of paper) is more yielding than a thick sheet (such as a thick sheet of paper) and is more likely to deform. Hence, when the sheet 201 contacts the sheet sensor 202, the leading edge of the sheet 201 may deform and ride up on the sheet sensor 202, as shown in FIG. 13. This causes a delay in the timing at which the sheet 201 switches the sheet sensor 202 from an OFF state to an ON state, thereby delaying detection of the leading edge. Further, when the trailing edge of the sheet 201 approaches the sheet sensor 202, the restorative force of the actuator 203 flips up the trailing edge as shown in FIG. 14, causing the trailing edge to deform before the sheet 201 has completely passed over the actuator 203 and to ride up on the sheet sensor 202. This speeds up the timing at which the sheet sensor 202 changes from the ON state to the OFF state, causing the sheet sensor 202 to detect the trailing edge of the sheet 201 too early.

When the sheet sensor 202 detects the leading edge of the sheet 201 too late as shown in FIG. 13, the image-forming device perceives the length of the sheet 201 to be a distance L1 shorter than the actual length. Further, when the sheet sensor 202 detects the trailing edge of the sheet 201 too early as shown in FIG. 14, the image-forming device perceives the length of the sheet 201 to be a distance L2 shorter than the actual length. If the sheet sensor 202 errs on detecting both the leading edge and the trailing edge, then the length of the sheet 201 perceived by the image-forming device is doubly shortened by the distances L1 and L2. In such a case, the image-forming device feeds a succeeding sheet 201 to the conveying means before the prescribed gap is formed between the preceding sheet 201 and the succeeding sheet 201. As a result, as shown in FIG. 15, the prescribed conveying gap N1 between consecutively fed sheets 201A and 201B is reduced by a length N3, resulting in a conveying gap N2 between the sheets 201A and 201B.

The image-forming device can increase the number of printed sheets per unit time by further shrinking the gap between the conveyed sheets 201 from the gap formed at the time of feeding (when the sheets are initially fed to the conveying means) just prior to the image-forming position, thereby reducing the amount of time loss caused by the conveying gap. However, if the conveying gap between the sheets 201 is reduced at the time of feeding, the succeeding sheet 201B may be too near or may overlap the trailing edge of the preceding sheet 201A at or just prior to the image-forming position. Since the process of removing the sheets 201 is troublesome when an actual paper jam occurs, the image-forming device may determine that a paper jam has occurred when the sheet 201B becomes too close to or overlaps the sheet 201A and may forcibly halt the printing operation at that time.

In addition, an actuator of the discharge sensor is considerably long in order to prevent the curled sheet 201 from floating up off the discharge sensor and escaping detection. Hence, the actuator of the discharge sensor requires a longer time to displace from an ON state position to an OFF state position.

As shown in FIG. 15, when the conveying gap N2 between consecutively fed sheets 201A and 201B is shorter than the prescribed conveying gap N1 when the sheets are fed, the conveying gap between the sheets 201A and 201B conveyed from the image-forming position to the discharge position becomes even shorter, and the succeeding sheet 201B may press against the actuator of the discharge sensor before the actuator can return to the OFF state after passage of the sheet 201A. Therefore, the discharge sensor may not detect the trailing edge of the preceding sheet 201A. In such a case, the image-forming device perceives the sheet 201A to be longer than its actual length and incorrectly determines that a paper jam has occurred. While this problem can be resolved by widening the conveying gap between the sheets 201, it may not be possible to achieve the required throughput.

In view of the foregoing, it is an object of the invention to provide an image forming device capable of reliably controlling conveyance of recording medium while maintaining the maximum throughput.

In order to attain the above and other objects, the invention provides an image-forming device including a feeding member that feeds a recording sheet, a conveying member that conveys the recording sheet fed by the feeding member, an image-forming member that forms an image on the recording sheet conveyed by the conveying member, and a controller that adjusts, when the conveying member conveys recording sheets consecutively, a conveying gap between the consecutively fed recording sheets based on a thickness of the recording sheet.

The invention also provides a control method for controlling a conveyance of a recording sheet in an image forming device. The control method including determining a thickness of a recording sheet, and adjusting a conveying gap between consecutively fed recording sheets based on the determined thickness.

BRIEF DESCRIPTION OF THE DRAWINGS

Illustrative aspects in accordance with the invention will be described in detail with reference to the following figures wherein.

DETAILED DESCRIPTION

A laser printer 1 as an image forming device according to some aspects of the invention will be described while referring to the accompanying drawings.

In the following description, a depth direction of the laser printer 1 will be referred to as the X direction (the front surface side being +X), a width direction will be referred to as the Z direction (the near right side in FIG. 1 being +Z), and a height direction will be referred to as the Y direction (the upper side in FIG. 1 being +Y).

Figure 1:
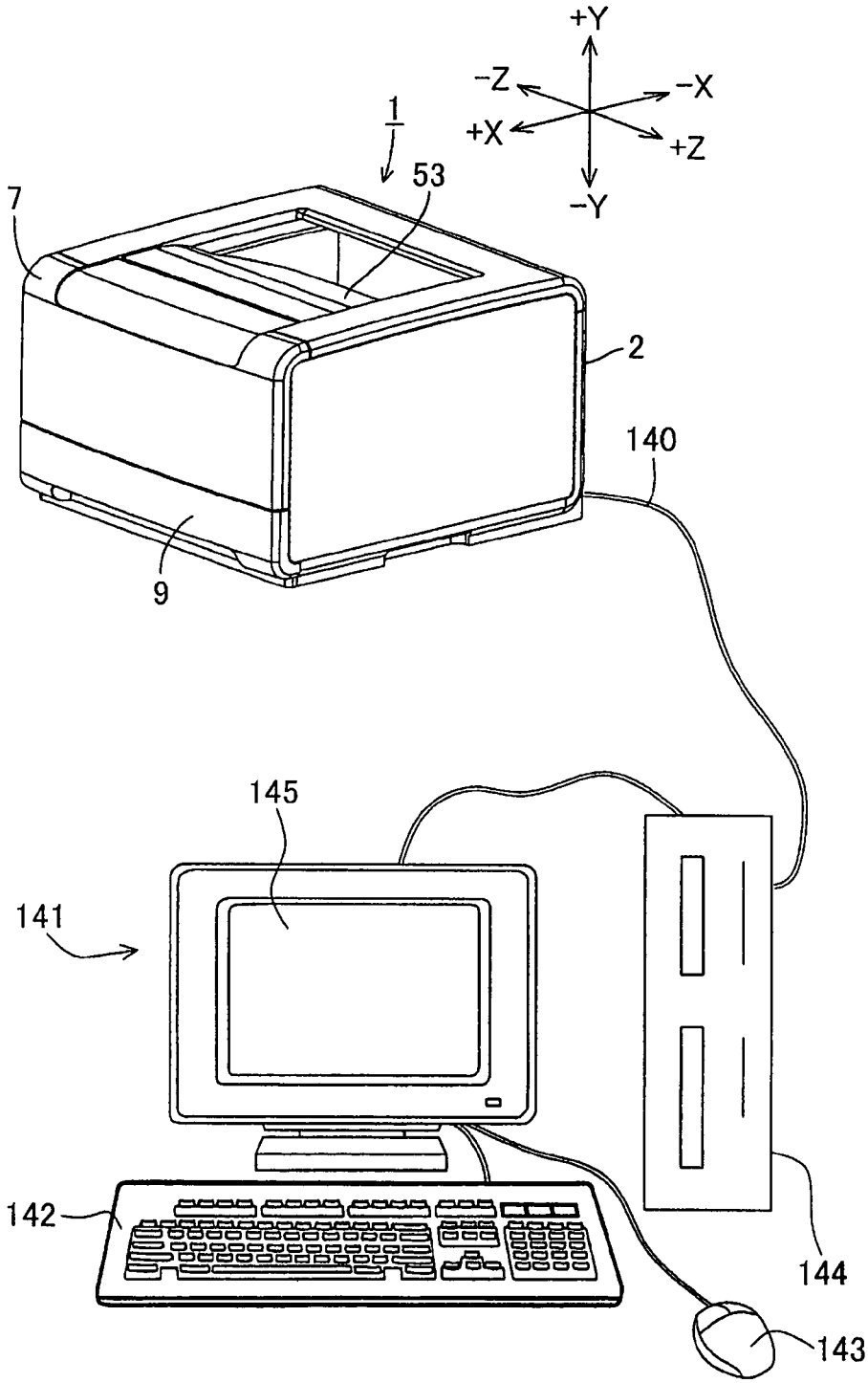
FIG. 1 is a perspective view of a personal computer connected to a laser printer according to some aspects of the invention.

As shown in FIG. 1, the laser printer 1 is connected to a personal computer 141 via a cable 140 so that the personal computer 141 and the laser printer 1 can communicate with each other. The personal computer 141 includes a keyboard 142, a mouse 143, a main system 144, and a display 145. A user can input data through the keyboard 142 and the mouse 143. The main system 144 has a built-in central processing unit (CPU), a random access memory (RAM), a read only memory (ROM), and the like for performing processes and arithmetic computations on this data. The display 145 is for displaying data outputted from the main system 144. The personal computer 141 can output printing instructions to the laser printer 1 via the cable 140 when the user has inputted such printing instructions using the keyboard 142 and the mouse 143, and the laser printer 1 can print a sheet of paper 3 (FIG. 2) based on the inputted data.

Here, "printing instructions" denotes data that the laser printer 1 requires for forming an image and includes a "print command" for the laser printer 1, "recording sheet data," and "print data."

The "recording sheet data" denotes information on a "recording sheet," which is a sheet like recording medium, and includes information on the type of recording sheet (thick paper, normal paper, thin paper, transparency, etc.), information on the sheet thickness, and information on the size and standard of the recording sheet.

"Print data" denotes data for images (hereinafter including text) to be formed on a recording sheet.

As shown in FIG. 1, the exterior of the laser printer 1 is configured of a main casing 2, a front cover 7, and a paper cassette 9.

Figure 2:
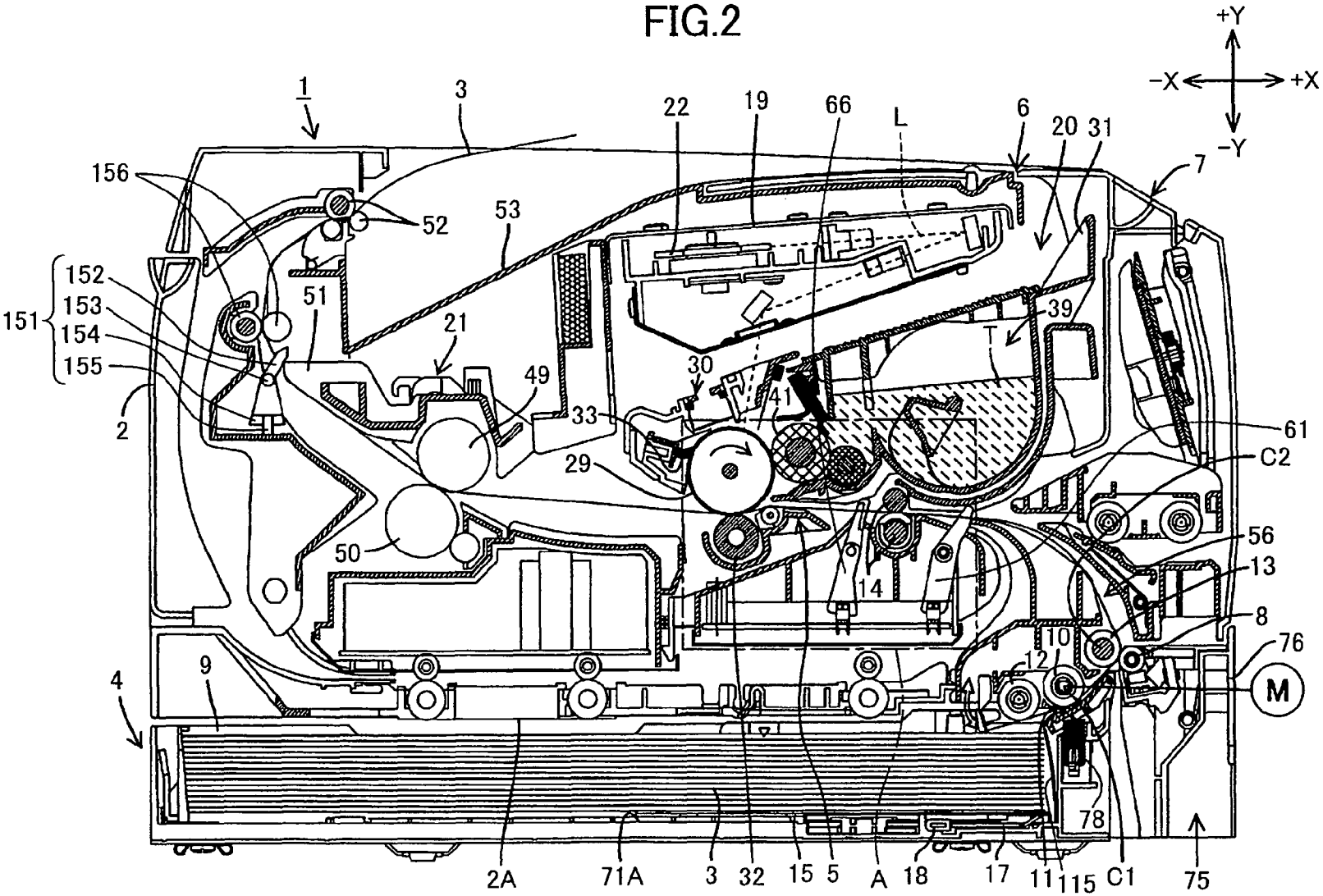
FIG. 2 is a side cross-sectional view showing the laser printer in FIG. 1.

As shown in FIG. 2, the laser printer 1 further includes a feeder unit 4 and an image forming unit 5 within the main casing 2. In the laser printer 1, paper 3 is picked up one sheet at a time from the feeder unit 4, printed with images, and then discharged onto a discharge tray 53 formed on top of the main casing 2.

An access opening 6 is formed in a top wall (wall on the +Y side) of the main casing 2 for inserting and removing a process cartridge 20 described later. The main casing 2 rotatably supports the front cover 7 so that the front cover 7 can open and close over the access opening 6.

A cassette-accommodating section 2A is provided in the bottom section of the main casing 2 and is open on the front side. Hence, a user can insert the paper cassette 9 into the cassette-accommodating section 2A or remove the paper cassette 9 therefrom through operations performed on the front side of the main casing 2.

Figure 3:
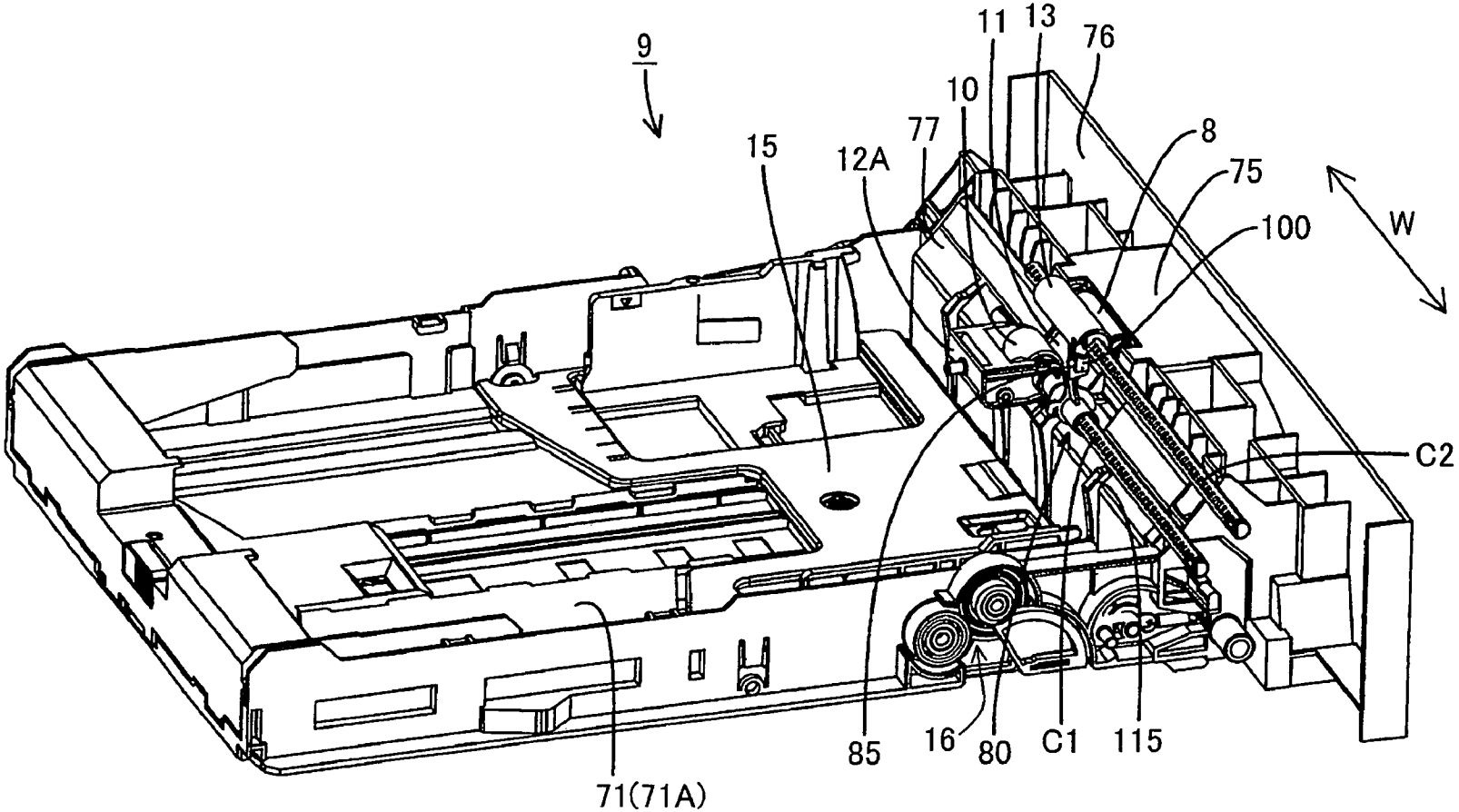
FIG. 3 is a perspective view of a paper cassette employed in the laser printer of FIG. 1.

The feeder unit 4 includes the paper cassette 9, a separating roller 10, a feeding roller 12, and a pinch roller 13. FIG. 3 is a perspective view of the paper cassette 9. Because the separating roller 10, the feeding roller 12, and the pinch roller 13 are mounted in the main casing 2, these components would not naturally appear in FIG. 3, but have been shown in FIG. 3 to illustrate their relationships with the paper cassette 9 or a paper dust roller 8 provided in the paper cassette 9.

As shown in FIG. 3, the paper cassette 9 includes a main cassette body 71 and a wall portion 75. The main cassette body 71 is shaped like a shallow tray for accommodating stacked sheets of the paper 3. The main cassette body 71 has a bottom wall 71A. A sheet-pressing plate 15 is mounted on the bottom wall 71A in the front region thereof. The rear end of the sheet-pressing plate 15 is fixed to the bottom wall 71A, while the front end is not fixed and can move vertically.

As shown in FIG. 2, a lever 17 is provided between the free end (front end) of the sheet-pressing plate 15 and the bottom wall 71A of the paper cassette 9. The lever 17 can rotate about a lever shaft 18.

The lever shaft 18 is engaged with a paper-feeding gear train 16 (see FIG. 3) disposed on the outer side wall of the paper cassette 9. The paper-feeding gear train 16 is engaged with a paper-feeding motor (not shown).

The paper-feeding gear train 16 is driven to rotate by the paper-feeding motor. When the rotational drive force of the paper-feeding gear train 16 (counterclockwise in FIG. 1) is applied to the lever shaft 18, the lever 17 pivots about the lever shaft 18. As a result, the front end of the lever 17 lifts the front end of the sheet-pressing plate 15 and, consequently, lifts the paper 3 stacked in the paper cassette 9 so that the paper 3 contacts the feeding roller 12 with sufficient pressure for the feeding roller 12 to pick up a sheet of the paper 3.

As shown in FIG. 3, the wall portion 75 is provided on the front of the main cassette body 71. The wall portion 75 includes a flat front plate 76 and a rear member 77. The rear member 77 has a sloped surface 77A on the opposite side from the flat front plate 76 that slopes downward toward the main cassette body 71. In the widthwise center region of the sloped surface 77A are provided the paper dust roller 8 and a separating pad 11 disposed in a vertical arrangement, and guide pieces 115 that protrude from the sloped surface 77A toward the center of the paper cassette 9 (leftward in FIG. 3). Five of the guide pieces 115 are disposed in intervals along the width of the paper cassette 9. As shown in FIG. 2, the guide pieces 115 are sloped to follow the path through which the front end of the sheet-pressing plate 15 passes when moving vertically and function to align the front edges of the paper 3 lifted by the sheet-pressing plate 15.

As shown in FIG. 2, a coil spring 78 is accommodated in the wall portion 75 for urging the separating pad 11 toward the separating roller 10. The feeding roller 12, the separating roller 10, and the pinch roller 13 are arranged in the order given on a front section of a ceiling wall constituting the cassette-accommodating section 2A (+X side), that is, at positions opposing the wall portion 75 of the paper cassette 9.

A brief description of the roller support structure will be described with reference to FIG. 3. The separating roller 10 and the pinch roller 13 are arranged so that central shafts C1 and C2 of the separating roller 10 and the pinch roller 13 respectively extend in a width direction W of the paper cassette 9. Both ends of the central shafts C1 and C2 are supported on the main casing 2 in a direction orthogonal to the paper-conveying direction. Unlike the separating roller 10 and the pinch roller 13, the feeding roller 12 (FIG. 2) does not have a central shaft that is linked to the main casing 2, but is rotatably held on the central shaft C1 by a holder 12A formed as three sides of a rectangle.

As will be described later, a pivoting link 80 is fitted over the central shaft C1 together with the separating roller 10.

When the paper cassette 9 is accommodated in the cassette-accommodating section 2A as shown in FIG. 2, the flat front plate 76 of the paper cassette 9 is flush with the front surface of the main casing 2 and covers the opening to the cassette-accommodating section 2A. At this time, the separating roller 10 is positioned in opposition to the separating pad 11 and the paper dust roller 8 in opposition to the pinch roller 13. As a result, the guide pieces 115 of the wall portion 75 together with the paper dust roller 8, the separating roller 10, the feeding roller 12, and the pinch roller 13 form a conveying path 56. Additionally, due to the urging force of the coil sprint 78, the separating pad 11 presses against the separating roller 10 in order to produce a suitable frictional force between the separating roller 10 and the paper 3 to prevent a plurality of overlapped sheets of paper 3 from being supplied onto the conveying path 56.

The laser printer 1 is also provided with a motor M shown in FIG. 2. A drive torque generated by the motor M is transmitted to the central shafts C1 and C2 via a drive transmission gear (not shown) and, consequently, to the separating roller 10, the feeding roller 12, and the pinch roller 13 for driving the separating roller 10, the feeding roller 12, and the pinch roller 13 to rotate. As shown in FIG. 2, the conveying path 56 curves back toward the rear near the paper dust roller 8 to form a U-shape. The conveying path 56 passes through a pair of registration rollers 14 disposed upstream of the image-forming unit 5. With this construction, the paper 3 is conveyed along the conveying path 56 by the driving of the motor M toward the image-forming unit 5 described later. A front registration sensor 61 and a rear registration sensor 66 described later are disposed on upstream and downstream sides respectively of the registration roller 14.

Driving of the motor M is controlled by a control unit 120 (FIG. 8) described later. According to the aspects, when the personal computer 141 inputs printing instructions into the laser printer 1 via the cable 140, a motor drive circuit 136 (see FIG. 8) of the control unit 120 drives the motor M. Driving of the motor M is halted when the printing has completed. The main casing 2 incorporates a mechanism for interrupting power supply to the motor drive circuit 136 when the paper cassette 9 is removed. Hence, driving of the motor M is halted when the paper cassette 9 is not mounted in the cassette-accommodating section 2A.

As shown in FIG. 2, the image forming unit 5 includes a scanner unit 19, the process cartridge 20, and a fixing unit 21. The scanner unit 19 includes a light source (not shown), a polygon mirror 22, lenses, and reflection mirrors.

The process cartridge 20 includes a photosensitive drum 29, a Scorotron charger 30, a developing cartridge 31, a transfer roller 32, and a cleaning brush 33. The photosensitive drum 29 has a photosensitive layer on its surface and is rotatably supported. The charger 30 is for charging the surface of the photosensitive drum 29. The developing cartridge 31 has a developing roller 41 and an accommodating chamber 39 accommodating toner T as developer. The transfer roller 32 is disposed in confrontation with the photosensitive drum 29 so as to form a nip portion between the transfer roller 32 and the photosensitive drum 29 at a transfer position.

The fixing unit 21 includes a heat roller 49 including a halogen lamp or the like for generating heat and a pressure roller 50 disposed in press contact with the heat roller 49.

In the image forming unit 5, first the charger 30 uniformly charges the entire surface of the photosensitive drum 29. Then, a laser beam is emitted from the light source (not shown) based on image data. The laser beam is redirected by the polygon mirror 22, and passes through or reflected by the lenses and the reflection mirrors so as to irradiate, in a high speed scanning operation, the surface of the photosensitive drum 29. As a result, an electrostatic latent image corresponding to the image data is formed on the surface of the photosensitive drum 29.

Then, the developer roller 41 supplies the toner T accommodated in the accommodating chamber 39 onto the surface of the photosensitive drum 29. As a result, a toner image (visible image) corresponding to the electrostatic latent image is formed on the photosensitive drum 29. As the paper 3 transferred from the registration rollers 14 passes through the transfer position between the photosensitive drum 29 and the transfer roller 32, the toner image (toner T) on the photosensitive drum 29 is transferred onto the paper 3. At this time, the transfer roller 32 is applied with a transfer bias. Toner T remaining on the surface of the photosensitive drum 29 after the transfer operation is removed by the cleaning brush 33. In this way, the photosensitive drum 29 is capable of forming the following image.

The paper 3 formed with the toner image on its surface is conveyed to the fixing unit 21. In the fixing unit 21, the toner image on the paper 3 is thermally fixed on the paper 3 as the paper 3 passes between the heat roller 49 and the pressure roller 50.

After the toner T is fixed on the paper 3, the paper 3 is conveyed along a discharge path 51 extending vertically (Y direction) toward the top surface of the main casing 2. Since the paper 3 has a curl due to the heat and pressure applied in the fixing unit 21, a pair of pinch rollers 156 is provided along the discharge path 51 to remove the curl. Subsequently, a pair of discharge rollers 52 disposed near the top of the discharge path 51 discharge the paper 3 onto the discharge tray 53. A discharge sensor 151 described later is disposed along the discharge path 51 upstream of the discharge rollers 52 and the pinch rollers 156.

The laser printer 1 is also provided with a sheet detecting mechanism for detecting the conveyed state of the paper 3. As shown in FIG. 2, the sheet detecting mechanism includes the front registration sensor 61, the rear registration sensor 66, the pivoting link 80 (see FIG. 3), and the discharge sensor 151.

Figure 4:
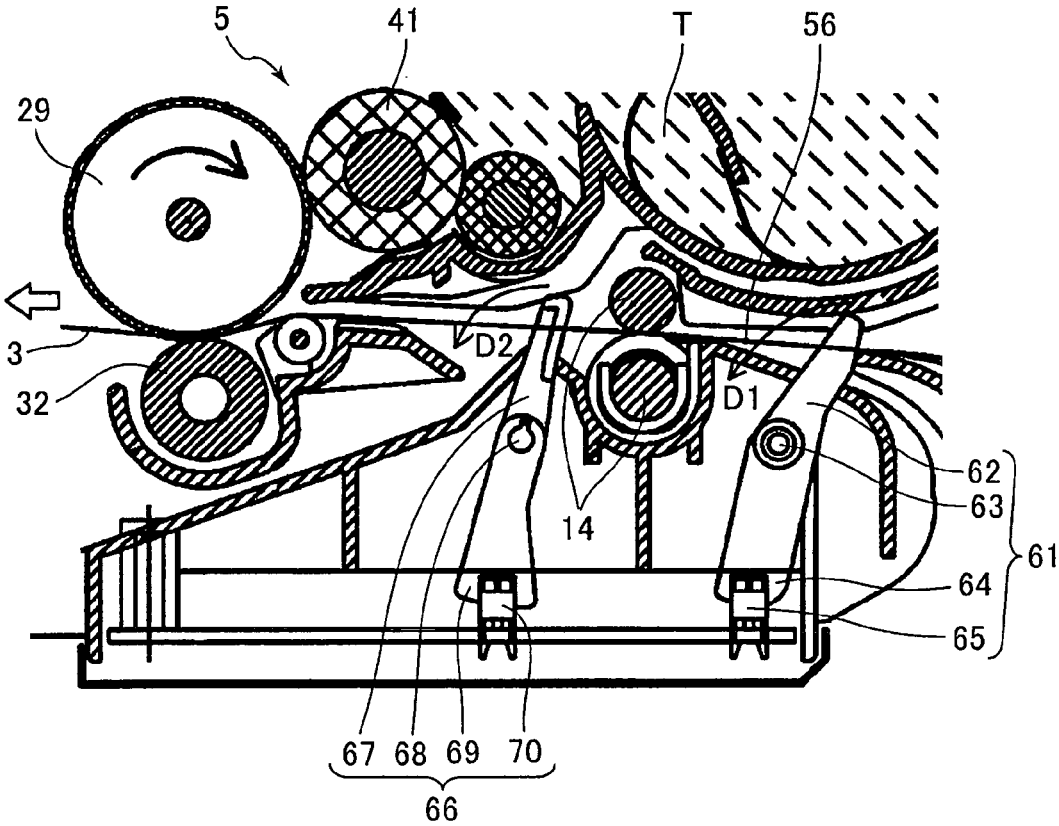
FIG. 4 is an enlarged view of a region A indicated in FIG. 2.

FIG. 4 is an enlarged view of a region A shown in FIG. 2. The front registration sensor 61 is disposed on the upstream side of the registration rollers 14 for detecting the leading edge of a sheet of paper 3 supplied toward the registration rollers 14. The rear registration sensor 66 is disposed on the downstream side of the registration rollers 14 for detecting the paper 3 supplied from the registration rollers 14 toward the image-forming unit 5.

The front registration sensor 61 and the rear registration sensor 66 include respective actuators 62 and 67, support shafts 63 and 68, light-shielding members 64 and 69, and detectors 65 and 70 (photo interrupters in the aspects). The actuators 62 and 67 have prescribed lengths. The support shafts 63 and 68 are fixed inside the main casing 2 for pivotably supporting the respective actuators 62 and 67 so that front ends of the actuators 62 and 67 protrude into the conveying path 56. The light-shielding members 64 and 69 are provided on the rear ends of the respective actuators 62 and 67 and are capable of rotating integrally with the respective actuators 62 and 67. The detectors 65 and 70 are disposed beneath the respective actuators 62 and 67 along paths through which the rear ends of the actuators 62 and 67 move. When the front registration sensor 61 and the rear registration sensor 66 are in a mounted state (that is, when the actuators 62 and 67, the light-shielding members 64 and 69, and the detectors 65 and 70 are installed and when a sheet of paper 3 is not being conveyed), the actuators 62 and 67 hang in a substantially vertical orientation by their own weight so that the light-shielding members 64 and 69 block the optical path of a detection light emitted from the detectors 65 and 70.

Hence, when a sheet of the paper 3 is not pressing against the actuators 62 and 67, the actuators 62 and 67 hang in a substantially vertical orientation with the light-shielding members 64 and 69 interrupting light emitted by the detectors 65 and 70. Accordingly, detection results by the detectors 65 and 70 indicate an OFF state. However, when a sheet of paper 3 presses against the actuators 62 and 67, rotating the actuators 62 and 67 counterclockwise in FIG. 4 (indicated by arrows D1 and D2), the actuators 62 and 67 rotate into a tilted orientation. Since the light-shielding members 64 and 69 move integrally with the actuators 62 and 67, the optical paths of the detectors 65 and 70 open up, and the detection results by the detectors 65 and 70 indicate an ON state. Once the sheet of paper 3 no longer presses against the actuators 62 and 67, the actuators 62 and 67 rotate clockwise in FIG. 4 (the directions opposite those indicated by arrows D1 and D2) by their own weight and return to their original vertical orientation.

Figure 5:
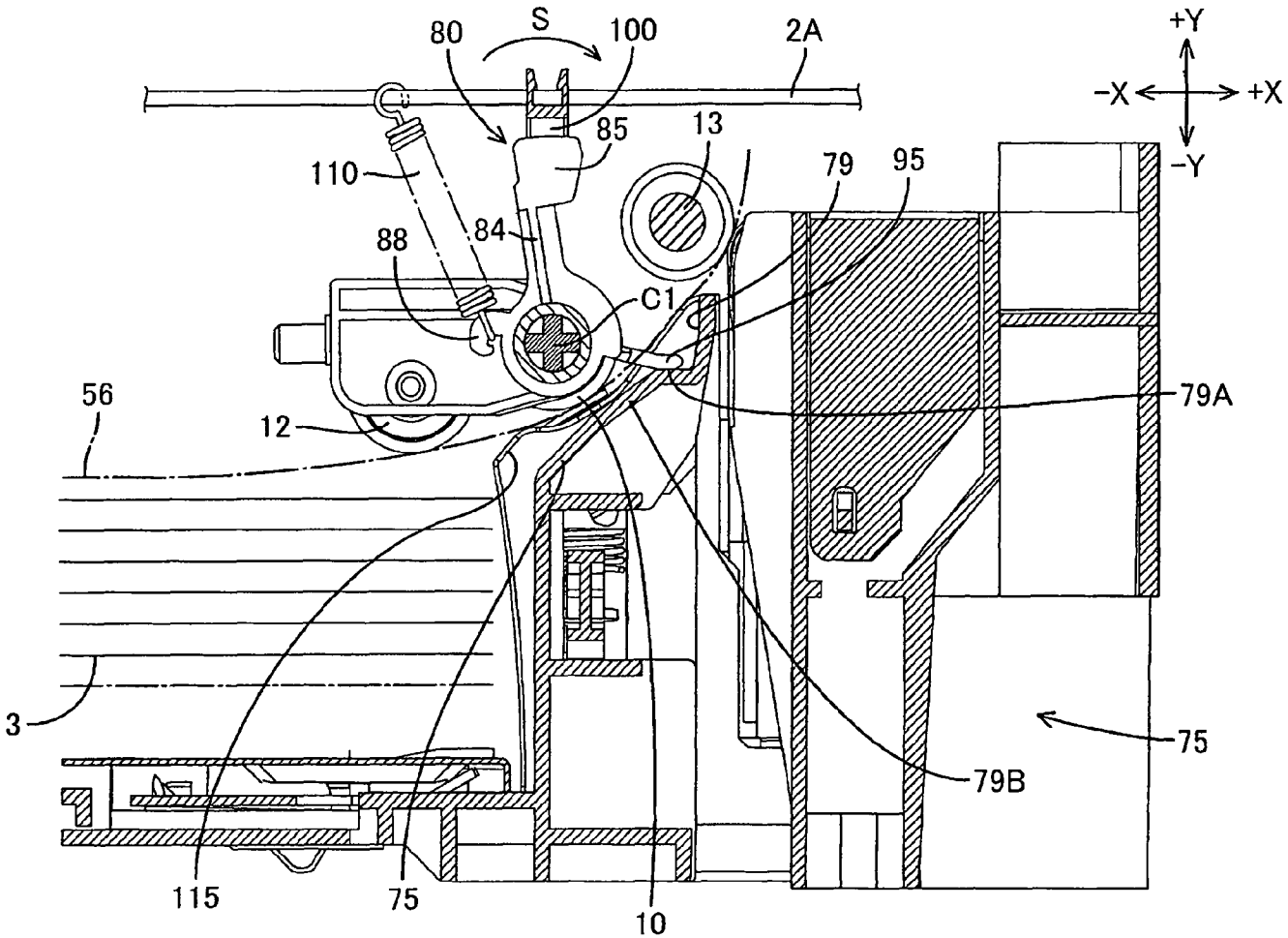
FIG. 5 is a cross-sectional view showing a first orientation of a pivot link employed in the laser printer in FIG. 1.

As shown in FIG. 5, the pivoting link 80 is fitted over the central shaft C1 with a slight gap so as to be capable of rotating freely (so as not to rotate together with the central shaft C1). The pivoting link 80 includes an arm 84, shielding plate 85, and a protruding plate part 95.

The arm 84 extends upward from a base part of the pivoting link 80 supported around the central shaft C1. The shielding plate 85 is provided on the top end of the arm 84. Here, a description will be given for a photoelectric sensor 100 positioned opposite the shielding plate 85 for detecting a light-blocking object. The photoelectric sensor 100 includes a light-emitting element and a light-receiving element disposed in positions facing each other. In the aspects, a transparent photointerrupter in which the photoelectric elements have been packaged is used.

The photoelectric sensor 100 is fixed to the upper wall of the cassette-accommodating section 2A at a position above the pivoting link 80 and extends along the central shaft C1. When the components are assembled (that is, when the photoelectric sensor 100, the pivoting link 80, and the paper cassette 9 are installed and a sheet of paper 3 is not being conveyed), the shielding plate 85 of the pivoting link 80 is positioned between the light-emitting element and the light-receiving element of the photoelectric sensor 100.

The protruding plate part 95 extends toward the wall portion 75 of the paper cassette 9. An end 95A of the protruding plate part 95 is bent slightly. A receiving part 79 is formed in the wall portion 75 by depressing the side wall downward at a position opposite the protruding plate part 95. The bottom portion of the receiving part 79 functions as a seat surface 79A.

Changes in the orientation of the pivoting link 80 will be described.

(First Orientation)

As shown in FIG. 5, when the paper cassette 9 is mounted in the cassette-accommodating section 2A, the protruding plate part 95 intersects the conveying path 56, and the bent end 95A of the protruding plate part 95 rests on the seat surface 79A of the receiving part 79. At this time, the arm 84 is in a substantially vertical orientation, and the shielding plate 85 blocks the path of detection light emitted from the light-emitting element (hereinafter, this state will be referred to as an "OFF state" for the sensor output). The pivoting link 80 is in a first orientation when the protruding plate part 95 is supported on top of the seat surface 79A of the receiving part 79 as described above.

The laser printer 1 also includes a coil spring 110 shown in FIG. 5, having one end attached to the upper wall of the cassette-accommodating section 2A and the other end engaged in a spring fastener 88 of the pivoting link 80. When the pivoting link 80 is in the first orientation, the coil spring 110 urges the pivoting link 80 in a direction indicated by an arrow S in FIG. 5.

(Second Orientation)

Figure 6:
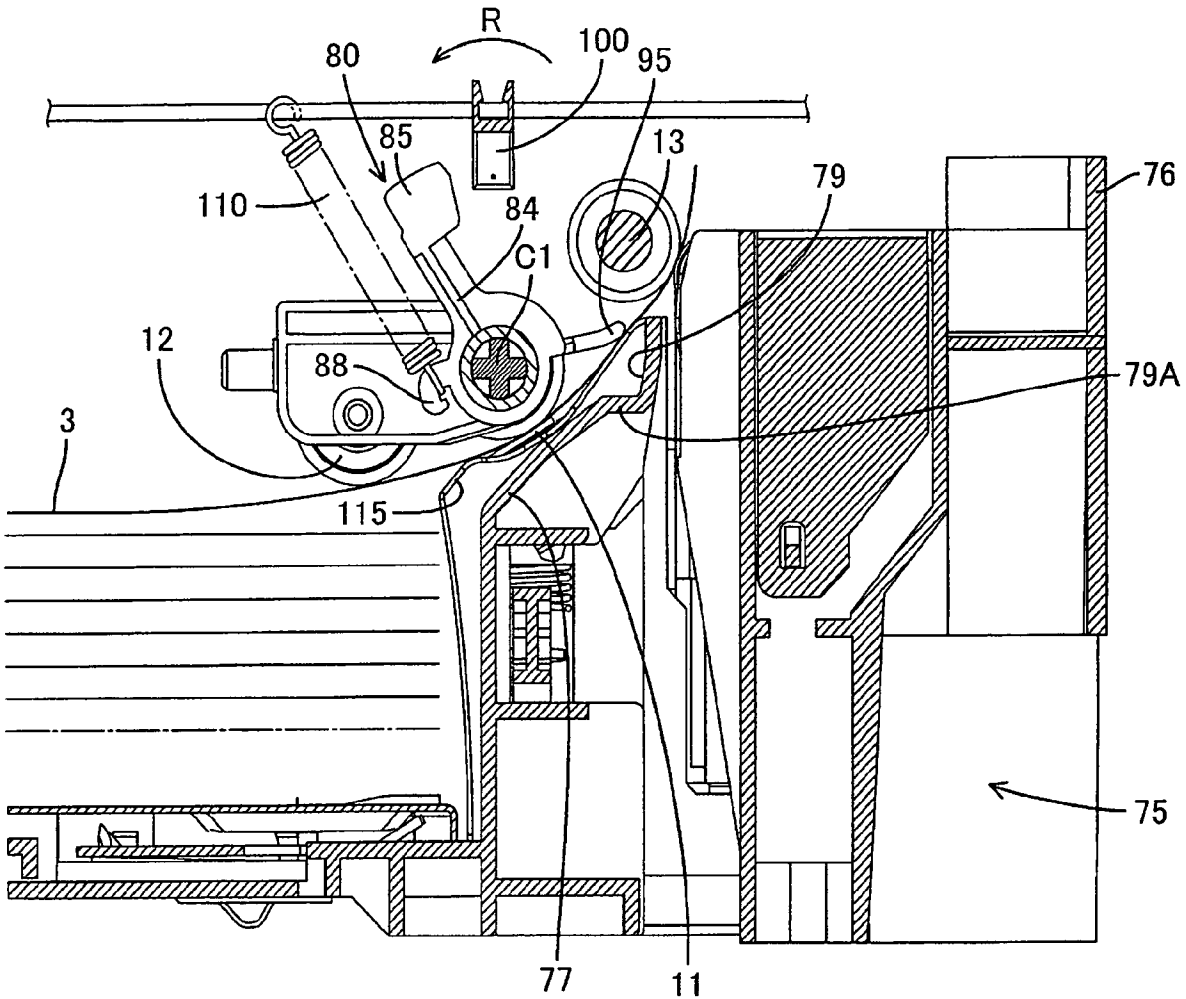
FIG. 6 is a cross-sectional view showing a second orientation of the pivot link in FIG. 5.

Hence, before a sheet of the paper 3 is conveyed, the protruding plate part 95 extends across the conveying path 56. When a sheet of the paper 3 is conveyed, the protruding plate part 95 is flipped upward by the paper 3, causing the pivoting link 80 to rotate in the direction indicated by an arrow R in FIG. 6. When the pivoting link 80 rotates in this direction, the shielding plate 85 is retracted from the optical path of the detection light, enabling the photoelectric sensor 100 to receive light (hereinafter referred to as an "ON state" of the sensor output). The second orientation of the pivoting link 80 is the orientation in which the protruding plate part 95 is flipped upward as shown in FIG. 6.

While the paper 3 is conveyed, the pivoting link 80 is maintained in the second orientation, as the lower surface of the protruding plate part 95 is supported on the paper 3. After the trailing edge of the paper 3 passes the protruding plate part 95 and the support of the paper 3 is removed (the protruding plate part 95 is in a free state), the pivoting link 80 returns to its original first orientation shown in FIG. 5 due to the urging force of the coil spring 110 described above.

In this construction, the pivoting link 80 is disposed with the protruding plate part 95 downstream of the separating roller 10. Therefore, even when the feeding roller 12 picks up a plurality of sheets of paper 3 from the paper cassette 9, the separating roller 10 can supply the paper 3 to the pinch roller 13 one sheet at a time, enabling the pivoting link 80 to detect the leading edge and the trailing edge of the paper 3 one sheet at a time.

(Third Orientation)

Figure 7:
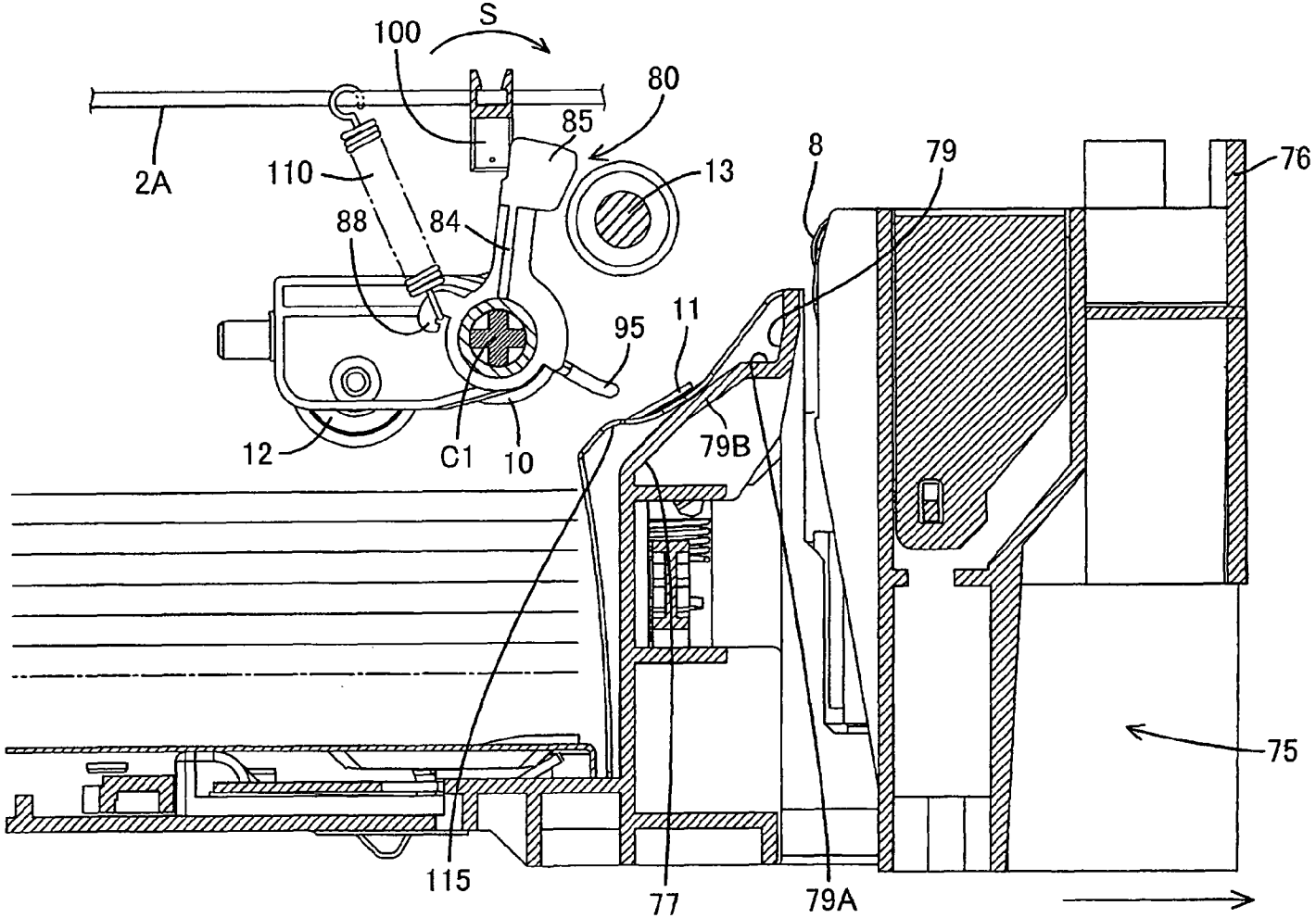
FIG. 7 is a cross-sectional view showing a third orientation of the pivot link in FIG. 5.

If the paper cassette 9 is removed by moving the entire paper cassette 9 from the state shown in FIG. 5 toward the right in the drawing, the support of the receiving part 79 is removed from beneath the protruding plate part 95 as shown in FIG. 7. Immediately after the support is removed, the pivoting link 80 rotates in the direction indicated by an arrow S in FIG. 7 due to the urging force of the coil spring 110. A stopper (not shown) is also provided on the pivoting link 80 for contacting an end face of the separating roller 10, halting the rotation of the pivoting link 80. At this time, the shielding plate 85 is retracted from the optical path of the detection light, enabling the photoelectric sensor 100 to receive light (ON state). This position is the third orientation of the pivoting link 80.

However, when the paper cassette 9 is inserted into the cassette-accommodating section 2A from this orientation, the bent end 95A of the protruding plate part 95 is contacted by a sloped guiding surface 79B of the wall portion 75. As the protruding plate part 95 is guided up the sloped guiding surface 79B, the pivoting link 80 rotates in the direction R against the urging force of the coil spring 110. By the time the paper cassette 9 is completely accommodated in the cassette-accommodating section 2A, the protruding plate part 95 has slid over the sloped guiding surface 79B and is supported from below by the seat surface 79A of the receiving part 79. In other words, the pivoting link 80 is in the first orientation shown in FIG. 5.

The orientation of the pivoting link 80 and changes therein are identified as follows. The pivoting link 80 is determined to be in the first orientation when the photoelectric sensor 100 is in an OFF state. However, when the photoelectric sensor 100 changes from an OFF to an ON state, then the pivoting link 80 has rotated either in the R direction shown in FIG. 6 or the S direction shown in FIG. 7 from the first orientation. Therefore, the orientation of the pivoting link 80 is determined to be either the second orientation shown in FIG. 6 or the third orientation shown in FIG. 7. Since the driving of the motor M halts when the paper cassette 9 is removed, the pivoting link 80 is determined to be in the second orientation shown in FIG. 6 when the photoelectric sensor 100 is in the ON state and the motor M is being driven and in the third orientation shown in FIG. 7 when the photoelectric sensor 100 is in the ON state and the motor M is stopped.

The discharge sensor 151 will be described with reference to FIG. 2. The discharge sensor 151 is disposed on the upstream side of the pinch rollers 156 for detecting the paper 3 supplied from the fixing unit 21 toward the discharge rollers 52.

The discharge sensor 151 includes an actuator 152, a shaft 153, a light-shielding member 154, and a detector 155 (photointerrupter in the aspects). The actuator 152 has a prescribed length. The shaft 153 is fixed inside the main casing 2 for pivotably supporting the actuator 152 so that a front end of the actuator 152 protrudes into the conveying path 51. The light-shielding member 154 is provided on the rear end of the actuator 152 and is capable of rotating integrally with the actuator 152. The detector 155 is disposed along a path through which the rear end of the actuator 152 moves. When the discharge sensor 151 is in a mounted state (that is, when the actuator 152, the light-shielding member 154, and the detector 155 are installed and when a sheet of paper 3 is not being conveyed), the actuator 152 hangs in a substantially vertical orientation by its own weight so that the light-shielding member 154 blocks the optical path of a detection light emitted from the detector 155.

In the discharge sensor 151 having this construction, the actuator 152 hangs in a substantially vertical orientation when not being pressed by a sheet of paper 3, with a front end protruding into the conveying path 51, as shown in FIG. 2. At this time, the light-shielding member 154 blocks the path of light from the detector 155 so that the detection results from the detector 155 indicate an OFF state. When a sheet of paper 3 presses against the actuator 152, the actuator 152 rotates counterclockwise in FIG. 2 so that the front end is retracted from the conveying path 51. Since the light-shielding member 154 moves together with the actuator 152, the optical path of the detector 155 becomes clear, and the detection results from the detector 155 change from an OFF state to an ON state. When the paper 3 no longer presses against the actuator 152, the actuator 152 rotates clockwise in FIG. 2 by its own weight, returning to the original orientation. At this time, the detection results from the detector 155 change from an ON state to an OFF state.

The actuator 152 is considerably long so as to protrude far into the conveying path 51 in order to prevent the curled paper 3 from floating up off the discharge sensor 151 and escaping detection. Hence, the actuator 152 requires a longer time to displace from an ON state position to an OFF state position.

Figure 8:
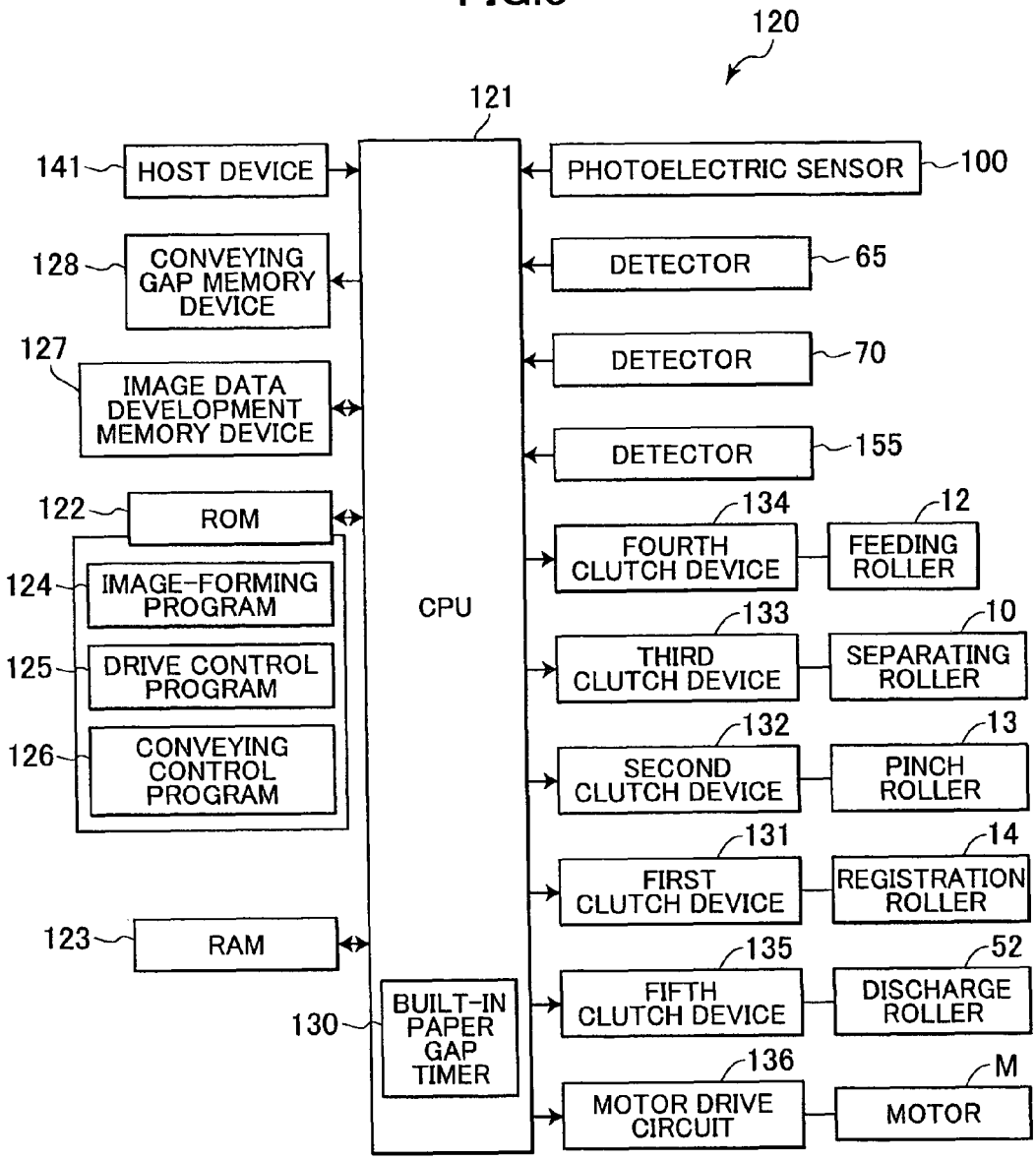
FIG. 8 is a block diagram showing a control hardware configuration of the laser printer in FIG. 1.

Next, a hardware construction for electrically controlling the laser printer 1 will be described. FIG. 8 is a block diagram showing the hardware structure.

As shown in FIG. 8, the laser printer 1 includes the control unit 120, mentioned earlier, configured around a CPU 121 for performing data processing and arithmetic computations. The CPU 121 is connected to a ROM 122, a RAM 123, the personal computer 141, an image data development memory device 127, and a conveying gap memory device 128.

The ROM 122 stores various programs, initial values, and the like. The programs include an image-forming program 124, a drive control program 125, and a conveying control program 126.

The image-forming program 124 is for controlling the timing for forming electrostatic latent images on the photosensitive drum 29 and the timing for forming images on the paper 3 based on the timing at which the rear registration sensor 66 detects the leading edge of the paper 3.

The drive control program 125 is for controlling the driving of the motor M and operations of first through fifth clutch devices 131, 132, 133, 134, and 135 provided in the drive transmission gear (not shown) in order to control the rotation of the separating roller 10, the feeding roller 12, the pinch roller 13, and the discharge roller 52. More specifically, the drive control program 125 the timing for supplying the paper 3 to the pinch roller 13 by controlling the rotation of the feeding roller 12 and the separating roller 10.

The conveying control program 126 is for adjusting a conveying gap between consecutively fed sheets of paper 3 based on a sheet thickness. The conveying control program 126 will be described later in greater detail.

The RAM 123 is for temporarily storing data. The personal computer 141 is the host device, and printing instructions received from the personal computer 141 is stored in the RAM 123. The image data development memory device 127 stores print data that the CPU 121 extracts from the printing instructions. The CPU 121 sequentially deletes the print data stored in the image data development memory device 127 as the print data is printed.

Figures 9, 10:
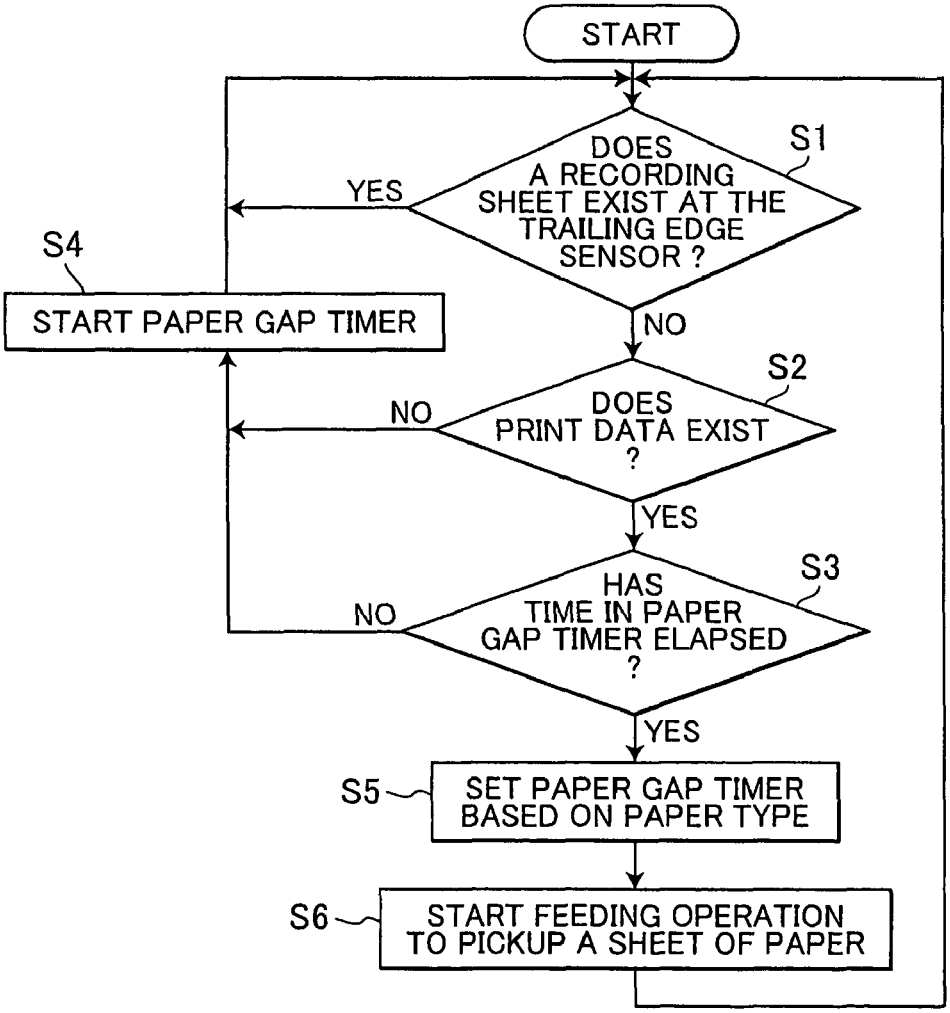
FIG. 9 is a table illustrating a data structure for a conveying gap memory area shown in FIG. 8.
FIG. 10 is a flowchart illustrating steps in a process for modifying the conveying gap executed according to a conveying gap modification program shown in FIG. 8.

The conveying gap memory device 128 stores a table such as that shown in FIG. 9 defining conveying gaps based on the type of recording sheet.

There are various types of recording sheets, such as thick paper, normal paper, and thin paper, each with a differing sheet thickness. It is well known that the stiffness of a recording sheet decreases for thinner sheets. Further, while transparency sheets may be stiffer than paper sheets due to the type of material, because transparencies exist in different thicknesses, some of which are more yielding than thin paper. The table in FIG. 9 lists thick paper, normal paper, thin paper, and transparencies (OHP) as examples of types of recording sheets.

Here, "conveying gap" denotes the distance between the trailing edge of a sheet of paper 3 conveyed first and the leading edge of a sheet of paper 3 conveyed after the first sheet. In the aspects, the conveying gap is managed by time, as shown in FIG. 9. The conveying gap for thick paper is set as a reference value in FIG. 9, while conveying gaps for the thinner, more yielding normal paper, thin paper, and transparencies are defined as the amount of expansion from the reference value. More specifically, the conveying gap for thick paper is used as the reference value and is set to 300 msec in the aspects. As shown in the table in FIG. 9, the conveying gap for normal paper, which is thinner than thick paper, is stipulated as the reference value (300 msec) +30 msec, and the conveying gap for thin paper, which is thinner than normal paper, is stipulated as the reference value (300 msec) +60 msec. The conveying gap for thin transparencies having less stiffness than thin paper is defined as the reference value (300 msec) +80 msec.

As shown in FIG. 8, the CPU 121 is also connected to and acquires detection results from various sensors, including the photoelectric sensor 100, the detector 65, the detector 70, and the detector 155 described above.

The CPU 121 is also connected to the motor drive circuit 136 for controlling the driving of the motor M. The CPU 121 is connected to the first through fifth clutch devices 131, 132, 133, 134, and 135 for individually controlling the drive force transmitted to each of the separating roller 10, the feeding roller 12, the pinch roller 13, the registration rollers 14, and the discharge roller 52.

For example, by connecting the second through fifth clutch devices 132-135 and disconnecting the first clutch device 131, the feeding roller 12, the separating roller 10, the pinch roller 13, and the discharge roller 52 are driven to rotate while the registration rollers 14 are halted. As a result, the leading edge of the paper 3 supplied from the paper cassette 9 onto the conveying path 56 runs into the halted registration rollers 14, producing a small amount of slack in the leading edge side of the paper 3 so that the leading edge of the paper 3 is orthogonal to the conveying path 56. Subsequently, the first clutch device 131 is connected so that the registration rollers 14 can rotate and convey the paper 3 to the image-forming unit 5. This operation removes any skew in the paper 3 to obtain proper registration.

The CPU 121 has a built-in paper gap timer 130. The paper gap timer 130 has a timer value set to the conveying gap corresponding to the type of recording sheet in FIG. 9 for each sheet of paper 3. The paper gap timer 130 begins counting down the time value when the trailing edge of the paper 3 is detected, that is, when the photoelectric sensor 100 changes from an ON state to an OFF state for adjusting the timing at which the next sheet of paper 3 is supplied. In other words, the paper gap timer 130 adjusts the conveying gap between consecutively fed sheets of paper 3.

Next, a process to adjust the conveying gap between consecutively fed sheets of paper 3 will be described with reference to the flowchart in FIG. 10. The CPU 121 performs the process in FIG. 10 by reading and executing the conveying control program 126 shown in FIG. 8. The conveying control program 126 is repeatedly executed at prescribed intervals (5 msec in the aspects) while power is supplied to the laser printer 1.

If the power to the laser printer 1 is turned ON while the paper cassette 9 is mounted in the cassette-accommodating section 2A, then in S1 the CPU 121 determines whether a sheet of paper 3 is present in the section of the pivoting link 80 by confirming the ON/OFF state of the photoelectric sensor 100. If the laser printer 1 is started up while the paper cassette 9 is mounted in the cassette-accommodating section 2A, then the protruding plate part 95 of the pivoting link 80 extends through the conveying path 56, with the bent end 95A resting on the seat surface 79A of the receiving part 79. Further, the arm 84 is substantially vertical in orientation, and the shielding plate 85 blocks the optical path of the detection light emitted from the light-emitting element so that output from the photoelectric sensor 100 indicates the OFF state. Hence, since a sheet of paper 3 does not exist in the pivoting link 80 at this time (S1: NO), then in S2 the CPU 121 determines whether any print data exists. Since no printing instructions have been received from the personal computer 141 at this time (S2: NO), then in S4 the CPU 121 starts the paper gap timer 130 and returns to S1. Hence, the CPU 121 is essentially in a wait state until printing instructions are received from the personal computer 141. Although the paper gap timer 130 is started in S4 during each loop of the wait state, the timer value has not been set in the paper gap timer 130 and remains at zero.

When the laser printer 1 receives printing instructions from the personal computer 141, the CPU 121 stores the printing instructions in the RAM 123, extracts the print data from the printing instructions, and stores the print data in the image data development memory device 127. Since the feeding roller 12 and the separating roller 10 have yet to pick up a sheet of paper 3 from the paper cassette 9 at the moment printing instructions are received and, hence, the output from the photoelectric sensor 100 indicates the OFF state, the CPU 121 determines that a sheet of paper 3 does not exist in the section of the pivoting link 80 (S1: NO) and advances to S2.

In S2 the CPU 121 again determines whether print data exists. This determination is made by confirming whether the image data development memory device 127 holds print data. Since the print data is stored in the image data development memory device 127 when the printing instructions are received, the CPU 121 determines that print data exists (S2: YES) and advances to S3. Note that if the process for determining the existence of print data in S2 is performed after executing the process in S5 and S6 described later, this determination is performed based on print data included with the next printing instructions.

In S3 the CPU 121 determines whether the time counted by the paper gap timer 130 has elapsed. Since the timer value for the paper gap timer 130 has yet to be set and remains at zero when the printing instructions are just received, the CPU 121 determines that the time has elapsed (S3: YES), and advances to S5.

In S5 the CPU 121 sets the timer value in the paper gap timer 130 based on the type of paper 3. Specifically, since the printing instructions include recording sheet data, the CPU 121 extracts the recording sheet data from the printing instructions stored in the RAM 123 and determines the type of paper 3 based on the extracted recoding sheet data. Then, the CPU 121 references the table shown in FIG. 9 using the determined type of paper 3 as an index and sets the timer value in the paper gap timer 130 to a value for producing the conveying gap corresponding to the type of paper 3 in the table. For example, if the CPU 121 determines that the paper 3 is "thin paper," then the CPU 121 sets the timer value in the paper gap timer 130 to the reference value (300 msec) +60 msec.

In S6 of FIG. 10, the CPU 121 connects the second through fifth clutch devices 132-135 to rotate the feeding roller 12, the separating roller 10, the pinch roller 13, and the discharge roller 52, beginning a feeding operation for picking up and feeding the paper 3. Since the topmost sheet of paper 3 in the paper cassette 9 is in contact with the feeding roller 12, the feeding roller 12 feeds the topmost sheet to the separating roller 10, and the sheet is subsequently conveyed to the pinch roller 13. After completing this process, the CPU 121 returns to S1.

In the next process, the paper 3 has been supplied from the separating roller 10 to the pinch roller 13, contacting the pivoting link 80 and changing the orientation of the pivoting link 80 to the second orientation. Since the output of the photoelectric sensor 100 has changed from an OFF state to an ON state due to the change in orientation of the pivoting link 80, in S1 the CPU 121 determines that the paper 3 exists in the region of the pivoting link 80 (S1: YES). At this time, the CPU 121 disconnects the third and fourth clutch devices 133 and 134 to temporarily halt rotation of the feeding roller 12 and the separating roller 10 so that a subsequent sheet of paper 3 is not supplied toward the pinch roller 13 after the current sheet. Then the CPU 121 loops back to S1.

In this way, the CPU 121 continues to loop back to S1 and does not reach S4 until the paper 3 has passed through the pivoting link 80. Therefore, the paper gap timer 130 is not started until this time.

When the paper 3 passes through the pivoting link 80, the pivoting link 80 is no longer pressed by the paper 3 and returns from the second orientation to the first orientation, and the photoelectric sensor 100 changes from the ON state to the OFF state. Since the paper 3 is no longer present in the region of the pivoting link 80 (S1: NO), the CPU 121 advances to S2.

In S2 the CPU 121 determines whether print data accompanying the next printing instructions exists in the image data development memory device 127. If the next printing instructions have been transmitted from the personal computer 141 at this time, then print data exists in the image data development memory device 127 (S2: YES). Accordingly, in S3 the CPU 121 determines whether the time set in the paper gap timer 130 has elapsed, that is, whether the paper gap timer 130 has counted down to zero. Since the paper gap timer 130 has not been started since the timer value was previously set in this example, the paper gap timer 130 has not counted down to zero (S3: NO). Therefore, the CPU 121 starts the paper gap timer 130 in S4 and returns to S1. On the other hand, if the personal computer 141 has not transmitted the next printing instructions, then the next print data does not exist in the image data development memory device 127 (S2: NO). Accordingly, the CPU 121 starts the paper gap timer 130 in S4 and returns to S1.

Assuming that the personal computer 141 has transmitted the next printing instructions (S2: YES), the CPU 121 repeatedly performs the processes S1-S4 described above until the time set in the paper gap timer 130 has elapsed (S3: YES). The paper gap timer 130 arriving at zero signifies that the conveying gap corresponding to the sheet thickness of the previously conveyed sheet of paper 3 has opened up behind the trailing edge of the same sheet. For example, when the paper 3 is thin paper, then the elapsed time in the paper gap timer 130 indicates that a conveying gap corresponding to the reference value (300 msec) +60 msec has opened up after the trailing edge of the previously conveyed sheet of paper 3.

In S5 the CPU 121 extracts the recording sheet data from the next printing instructions stored in the RAM 123, determines the type of paper 3 based on the recording sheet data, and resets the timer value in the paper gap timer 130. In S6 the CPU 121 connects the third and fourth clutch devices 133 and 134 to rotate the feeding roller 12 and the separating roller 10 again. The feeding roller 12 picks up the topmost sheet of paper 3 in the paper cassette 9, and the separating roller 10 supplies one sheet of the paper 3 to the pinch roller 13. Subsequently, the CPU 121 returns to S1.

The process in S1-S6 performed with the preceding sheet of paper 3 is similarly performed on the succeeding sheet of paper 3 so that a prescribed conveying gap corresponding to the sheet thickness of the succeeding sheet of paper 3 is opened up between this succeeding sheet and the sheet following this succeeding sheet. When subsequent printing instructions are not transmitted from the personal computer 141, the CPU 121 determines that there is no next print data (S2: NO). Therefore, in S4 the CPU 121 starts the paper gap timer 130, returns to S1, and repeatedly performs this process. Hence, the printing operation on the sheet of paper 3 ends without feeding another sheet.

As described above, according to the invention, when the pinch roller 13 continuously conveys paper 3 supplied from the separating roller 10 and the feeding roller 12, the laser printer 1 adjusts the conveying gap between the consecutively fed sheets of paper 3 based on the thickness of each sheet. In this way, the laser printer 1 can prevent paper jams due to different thicknesses in the sheets of paper 3.

Figure 13:
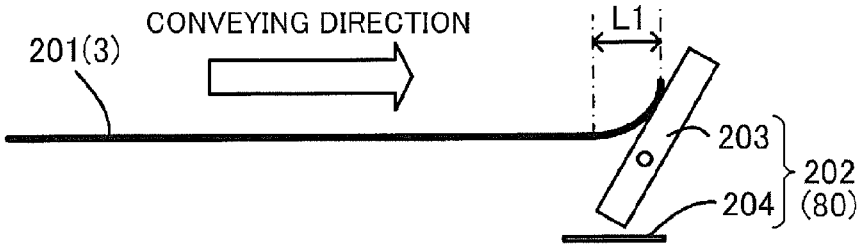
FIG. 13 is an explanatory diagram illustrating detection of the leading edge of the recording sheet.
Figure 14:
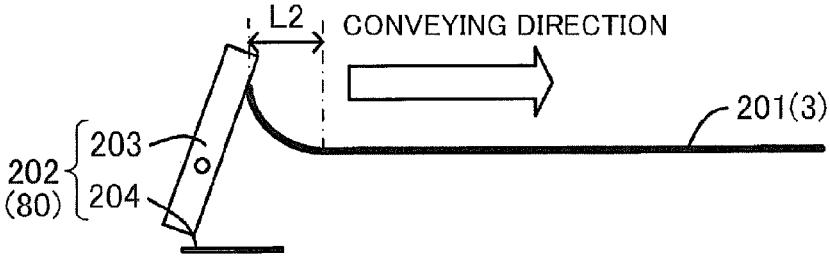
FIG. 14 is an explanatory diagram illustrating detection of the trailing edge of the recording sheet.
Figure 15:
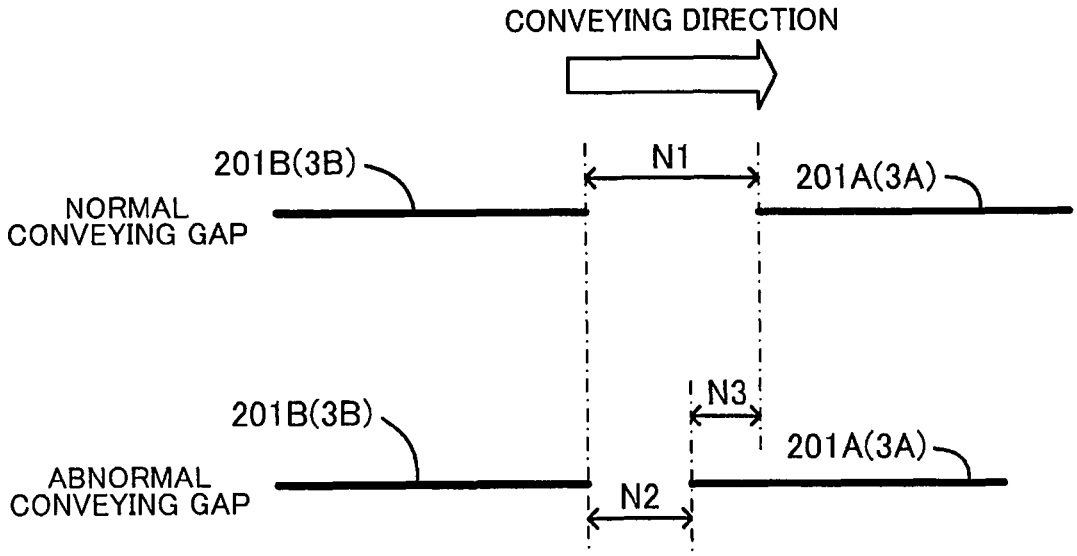
FIG. 15 is an explanatory diagram illustrating a reduction in a conveying gap between consecutively conveyed recording sheets.

That is, when sheets of paper 3 are fed consecutively, the laser printer 1 detects the paper 3 in the section of the pivoting link 80 based on the ON/OFF state of the photoelectric sensor 100. When the paper 3 is thin paper, for example, the leading edge or the trailing edge of the paper 3 can ride up on the pivoting link 80 as shown in FIGS. 13 and 14, throwing off the timing at which the pivoting link 80 detects the leading edge or the trailing edge of the paper 3. Therefore, when the pivoting link 80 is late in detecting the leading edge of the paper 3 as shown in FIG. 13, the laser printer 1 perceives the length of the paper 3 to be shorter by a length L1. Further, when the pivoting link 80 is early in detecting the trailing edge of the paper 3, the laser printer 1 perceives the length of the paper 3 to be shorter by a length L2. If the pivoting link 80 is off in detecting both the leading edge and the trailing edge, the laser printer 1 perceives the overall length of the paper 3 to be doubly shorter by the length L1 and L2.

Therefore, in the laser printer 1 according to the aspects, when the paper 3 is thin paper, the conveying gap between consecutively fed sheets of paper 3 is set to a gap equivalent to the reference value of 300 msec (the conveying gap for thick paper) plus a value of 60 msec considered equivalent to the amount the paper 3 deforms based on the sheet thickness and material. Accordingly, even when the length of the paper 3 is perceived to be shorter than the actual length, the laser printer 1 can allocate a conveying gap between the preceding sheet and the succeeding sheet corresponding to at least the reference value (300 msec). Hence, even when the laser printer 1 reduces the conveying gap between papers 3 at the registration roller 14 after the feeding roller 12 and the separating roller 10 have supplied the paper 3 to the pinch roller 13 in order to reduce time loss and increase the number of printed sheets per unit time, the laser printer 1 can prevent a succeeding sheet of paper 3 from being too close to or overlapping the trailing edge of the preceding sheet at the image-forming unit 5 or just before the image-forming unit 5, thereby preventing paper jams. In this way, the laser printer 1 according to the aspects feeds consecutive sheets of a thin paper 3 while allocating at least the conveying gap for thick paper. Accordingly, the laser printer 1 does not feed paper at a faster rate than its capacity; images formed on the paper 3 are not cut off on the trailing edge; and overruns are unlikely to occur in image processing, thereby achieving excellent printing quality.

Further, the laser printer 1 according to the aspects opens a conveying gap (the reference value of 300 msec +60 msec, for example) between consecutively fed sheets of paper 3 corresponding to the sheet thickness at the time of feeding. Accordingly, a prescribed gap can be maintained between the consecutively fed sheets from the image-forming position at the photosensitive drum 29 to the discharge tray 53, as well. As a result, even when consecutive sheets of thin paper 3 are fed, a succeeding sheet of paper 3 will not press against the actuator 152 after the preceding sheet has passed and before the actuator 152 can fully return from its orientation in the ON state to its orientation in the OFF state, thereby enabling the discharge sensor 151 to reliably detect the trailing edge of the preceding paper 3. Accordingly, the laser printer 1 can properly perceive the length of the paper 3 without mistakenly detecting a paper jam.

When expanding the conveying gap between consecutively fed sheets of paper 3 in this way, the conveying time increases by the amount of expansion, reducing printing efficiency. However, the laser printer 1 according to the aspects appropriately modifies the conveying gap between consecutively fed sheets of paper 3 based on the sheet thickness and can therefore obtain the maximum printing efficiency corresponding to the thickness of the paper 3 without needlessly increasing the conveying gap.

Hence, the laser printer 1 according to the aspects can reliably control conveyance of the paper 3 while maintaining the maximum throughput. Future trends in image-forming devices will likely call for further improvements in printing speed, leading to a shorter gap between conveyed sheets of paper 3. However, by modifying the conveying gap based on the thickness of the paper 3, it will be possible to minimize time loss to meet the demand for faster printing rates while preventing paper jams from occurring with thin sheets of paper 3, thereby improving printing efficiency.

Further, in the laser printer 1 according to the aspects, the sheet-pressing plate 15 presses the paper 3 in contact with the feeding roller 12; the feeding roller 12 rotates to feed the sheets of paper 3 to the separating roller 10; and the separating roller 10 supplies the paper 3 to the pinch roller 13 one sheet at a time. Hence, by controlling the timing at which the feeding roller 12 and the separating roller 10 are rotated and halted, the laser printer 1 can adjust the timing at which the feeding roller 12 and the separating roller 10 supply the paper 3 to the pinch roller 13. Speeding up the timing for feeding sheets of paper 3 decreases the conveying gap between consecutively fed sheets, while slowing down the timing expands the conveying gap. Hence, the laser printer 1 according to the aspects can easily adjust the conveying gap using the feeding roller 12 and the separating roller 10 in the existing technology.

Further, since the conveying gap between sheets of paper 3 is adjusted based on the recording sheet data transmitted from the personal computer 141, the laser printer 1 according to the above aspects can easily determine the sheet thickness based on data inputted by a user and transmitted from the personal computer 141.

Next, a laser printer according to additional aspects of the invention will be described. Note that except for the structure of the control hardware, the remaining construction of the laser printer according to the additional aspects is identical to the laser printer 1 according to the above aspects. Therefore, parts and components identical to those used in the above aspects are designated with the same reference numerals to avoid duplicating description. The following description will focus on the points of difference.

Figure 11:
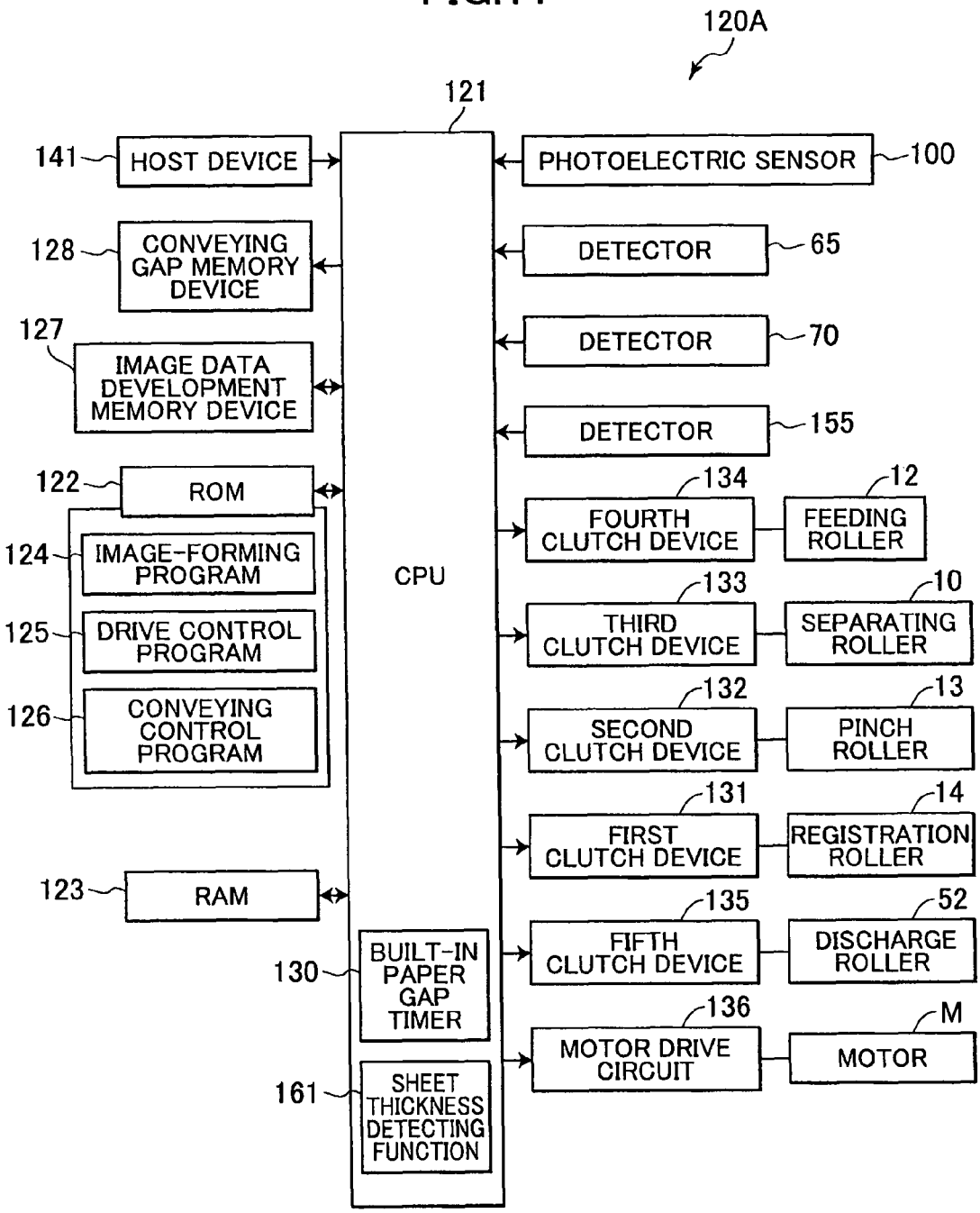
FIG. 11 is a block diagram showing a control hardware configuration of a laser printer according to additional aspects of the invention.
Figure 12:
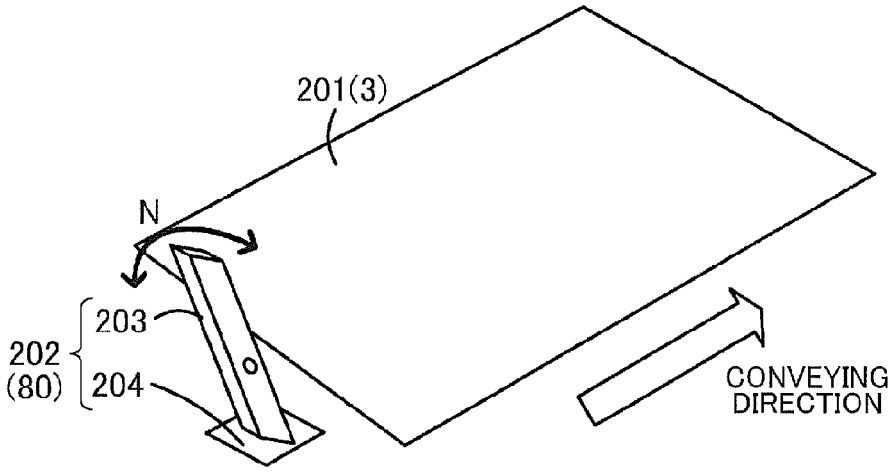
FIG.12 (Prior Art)
FIG. 12 is an explanatory diagram showing a construction for detecting a recording sheet.

FIG. 11 is a block diagram showing the control hardware structure employed in the laser printer according to the additional aspects. The laser printer according to the additional aspects has a control unit 120A. The control unit 120A is provided with a sheet thickness detecting function 161 for detecting the sheet thickness of the paper 3. Specifically, the sheet thickness detecting function 161 detects the conveying time required to convey the paper 3 from the paper cassette 9 to the registration rollers 14 by measuring the time beginning from when the photoelectric sensor 100 of the pivoting link 80 changes from an OFF state to an ON state until the time that the detector 65 of the front registration sensor 61 changes from an OFF state to an ON state, and detects the sheet thickness of the paper 3 based on this conveying time. Specifically, the sheet thickness detecting function 161 determines that the paper 3 is a thick paper if the conveying time exceeds an upper limit, determines the paper 3 is a normal paper if the conveying time is less than or equal to the upper limit and greater than or equal to a lower limit, and determines that the paper 3 is a thin paper or a transparency if the conveying time is less than the lower limit. It is also possible to differentiate the thin paper from the transparency based on the conveying time or by detecting the transmittance or reflectance of light incident on the paper 3.

This type of laser printer can automatically determine the thickness of the paper 3 conveyed from the paper cassette 9 to the conveying path 56 using the sheet thickness detecting function 161, even when paper of different thicknesses is combined in the paper cassette 9, and can adjust the conveying gap between consecutively fed sheets of paper 3 based on this determination. Hence, compared to the laser printer 1 according to the above aspects, the laser printer of the additional aspects reduces the operating load on the user by eliminating the need for the user to check the type of paper 3 in the paper cassette 9 and input this type in the personal computer 141 each time the user outputs printing instructions. The laser printer of the additional aspects can also eliminate incorrect settings for the type of recording sheet caused by errors in input operations, thereby improving the printing efficiency.

While the invention has been described in detail with reference to the above aspects thereof, it would be apparent to those skilled in the art that various changes and modifications may be made therein without departing from the spirit of the invention.

For example, in the above aspects, the laser printer adjusts the feeding timing by controlling the rotation of the separating roller 10 and the feeding roller 12 in order to adjust the conveying gap between consecutively fed sheets of paper 3. Alternatively, it is possible to adjust the conveying gap by controlling the rotation of the registration rollers 14. More specifically, the laser printer determines that a sheet of paper 3 exists in the section of the front registration sensor 61 when the detector 65 of the front registration sensor 61 changes from an OFF state to an ON state. At this time, the laser printer connects the first clutch device 131 to rotate the registration rollers 14 and convey the paper 3 to the image-forming unit 5. Subsequently, the laser printer determines that the paper 3 no longer exists in the section of the front registration sensor 61 when the detector 65 of the front registration sensor 61 changes from the ON state to the OFF state. At this time, the laser printer disconnects the first clutch device 131 to temporarily halt rotation of the registration rollers 14 and prevent the succeeding sheet of paper 3 from being conveyed to the image-forming unit 5. In the meantime, the succeeding sheet is picked up from the paper cassette 9 and conveyed to the registration rollers 14. When the time set in the paper gap timer 130 reaches zero, the laser printer again connects the first clutch device 131 to rotate the registration rollers 14 and convey the succeeding sheet of paper 3 to the image-forming unit 5. In this way, the laser printer can easily adjust the conveying gap formed between the trailing edge of a preceding sheet of paper 3 and the leading edge of a succeeding sheet of paper 3 using the existing registration rollers 14 by adjusting the timing at which the registration rollers 14 convey the paper 3 to the image-forming unit 5. It is also possible to adjust the conveying gap using the separating roller 10, the feeding roller 12, and the registration rollers 14.

While a laser printer is used as an example of the image-forming device in the above aspects, the image-forming device may be a color laser printer, an inkjet printer, a facsimile machine, a copier, or a multifunction device having such functions as a facsimile function, a scanner function, a copier function, and a printer function.

Although a sheet of paper 3 is detected using contact sensors in the above aspects, wherein the paper 3 contacts the pivoting link 80, the front registration sensor 61, the rear registration sensor 66, and the discharge sensor 151, it is possible to detect the paper 3 using a non-contact method in which the paper 3 passes between optical sensors.

While the personal computer 141 serves as the host device in the above aspects, the host device may be an inputting device provided directly on the laser printer 1, such as a control panel.

The timing values representing conveying gaps in FIG. 9 are merely examples and can be adjusted as appropriate. Further, although the conveying gap is controlled according to time in the above aspects, the conveying gap may be controlled by actually measuring the gap between consecutively fed sheets of paper 3 or based on the conveying speed.

In the above aspects, changes in the orientation of the pivoting link 80 are detected based on the state of the photoelectric sensor 100 and the driving state of the motor M. However, a sensor may be disposed near the pivoting link 80 for detecting positional changes in the pivoting link 80 relative to the sensor (displacement of the free end when the pivoting link 80 rotates). With this construction, the laser printer can identify the orientation of the pivoting link 80 from the amount of displacement in the free end of the pivoting link 80. This method may also be employed in the detector 65 of the front registration sensor 61 and the detector 70 of the rear registration sensor 66.

In the above aspects, light in the photoelectric sensor 100 is blocked when the pivoting link 80 is in the first orientation and unimpeded when the pivoting link 80 is in other orientations. However, the photoelectric sensor 100 may be configured so that light is received when the pivoting link 80 is in the first orientation and blocked when the pivoting link 80 is in other orientations. In this case, the pivoting link 80 must be provided with a plurality of light-shielding parts. The same configuration may be employed with the detector 65 of the front registration sensor 61 and the detector 70 of the rear registration sensor 66.

In the above aspects, the coil spring 110 is provided in the cassette-accommodating section 2A to improve the response of the pivoting link 80 to conveyance of the paper 3 and removal of the paper cassette 9. However, the coil spring 110 is not essential, and the orientation of the pivoting link 80 may be changed using its own weight. In contrast, the orientations of the front registration sensor 61, the rear registration sensor 66, and the discharge sensor 151 are controlled by the weight of these components, but an urging force may be applied to the front registration sensor 61, the rear registration sensor 66, and the discharge sensor 151 using a coil spring or other urging member to increase response.

In the above aspects, the laser printer detects the trailing edge of the paper 3 to control the conveying gap, but it is also possible to control the conveying gap by detecting the leading edge of the paper 3 or both the leading edge and the trailing edge.

In the additional aspects described above, the laser printer detects a conveying time for the paper 3 based on ON/OFF states for the photoelectric sensor 100 of the pivoting link 80 and the detector 65 of the front registration sensor 61 and detects the sheet thickness of the paper 3 based on the conveying time. However, the sheet thickness of the paper 3 can also be detected directly using an optical sensor or the like.

What is claimed is:

1. An image-forming device comprising:

an accommodating unit that accommodates a recording sheet;

a feeding member that feeds a recording sheet that is accommodated in the accommodating unit;

a conveying member that conveys the recording sheet fed by the feeding member;

an image-forming member that forms an image on the recording sheet conveyed by the conveying member;

a detector that detects a trailing end portion of a preceding recording sheet conveyed by the conveying member and that provides a detected timing of the trailing end portion of the preceding recording sheet, the trailing end portion of the preceding recording sheet being one of a trailing edge of the preceding recording sheet and a curled end portion of the preceding recording sheet that is adjacent to the trailing edge;

an obtaining unit that obtains, from an external device, recording sheet data indicative of a thickness of the preceding recording sheet; and a controller that adjusts, when the conveying member conveys the preceding recording sheet and a subsequent recording sheet consecutively, a feeding timing at which the feeding member starts to feeds the subsequent recording sheet from the accommodating unit, based on the recording sheet data indicative of the thickness of the preceding recording sheet and the detected timing of the trailing end portion of the preceding recording sheet to control a conveying gap between the preceding recording sheet and the subsequent recording sheet.

2. The image-forming device according to claim 1, wherein the controller adjusts the feeding timing such that the conveying gap between the preceding recording sheet and the subsequent recording sheet, when the preceding recording sheet is a thin recording sheet, is larger than the conveying gap between the preceding recording sheet and the subsequent recording sheet when the preceding recording sheet is a thick recording sheet.

3. A control method for controlling a conveyance of a recording sheet in an image forming device including an accommodating unit that accommodates a recording sheet, the control method comprising:

a) feeding a recording sheet that is accommodating in the accommodating unit:

b) detecting a trailing end portion of a preceding recording sheet, the trailing end portion of the preceding recording sheet being one of a trailing edge of the preceding recording sheet and a curled end portion of the preceding recording sheet that is adjacent to the trailing edge;

c) providing a detected timing of the trailing end portion of the preceding recording sheet;

d) determining a thickness of the preceding recording sheet; and e) adjusting a timing at which the feeding step a) starts to feeds the subsequent recording sheet from the accommodating unit, based on the thickness of the preceding recording sheet and the detected timing of the trailing end portion of the preceding recording sheet to control a conveying gap between the preceding recording sheet and the subsequent recording sheet.

4. The control method according to claim 3, wherein the thickness is determined in step d) based on data transmitted from an external device.

5. The control method according to claim 3, wherein the thickness is determined in step d) based on a detection result from a detector that detects the thickness of the recording sheet.

6. The control method according to claim 3, wherein the feeding timing is adjusted in step d) such that the conveying gap between the preceding recording sheet and the subsequent recording sheet, when the preceding recording sheet is a thin recording sheet, is larger than the conveying gap between the preceding recording sheet and the subsequent recording sheet when the preceding recording sheet is a thick recording sheet.

7. The control method according to claim 3, wherein the adjusting step e) adjusts the feeding timing such that the feeding timing is after a prescribed time has passed from the detected timing of the trailing end portion of the preceding recording sheet, to control the conveying gap between the preceding recording sheet and the subsequent recording sheet, the prescribed time being determined based on the thickness of the preceding recording sheet.

8. The image-forming device according to claim 1, wherein the controller adjusts the feeding timing such that the feeding timing is after a prescribed time has passed from the detected timing of the trailing end portion of the preceding recording sheet, to control the conveying gap between the preceding recording sheet and the subsequent recording sheet, the prescribed time being determined based on the recording sheet data of the preceding recording sheet.

9. An image-forming device comprising:

an accommodating unit that accommodates a recording sheet:

a feeding member that feeds a recording sheet that is accommodated in the accommodating unit;

a conveying member that conveys the recording sheet fed by the feeding member;

an image-forming member that forms an image on the recording sheet conveyed by the conveying member;

a first detector that detects a trailing end portion of a preceding recording sheet conveyed by the conveying member and that provides a detected timing of the trailing end portion of the of the preceding recording sheet, the trailing end portion of the preceding recording sheet being one of a trailing edge of the preceding recording sheet and a curled end portion of the preceding recording sheet that is adjacent to the trailing edge;

a second detector that detects a thickness of the preceding recording sheet; and a controller that adjusts, when the conveying member conveys the preceding recording sheet and a subsequent recording sheets consecutively, a feeding timing at which the feeding member starts to feeds the subsequent recording sheet from the accommodating unit, based on the thickness of the preceding recording sheet and the detected timing of the trailing end portion of the preceding recording sheet to control a conveying gap between the preceding recording sheet and the subsequent recording sheet.

10. The image-forming device according to claim 9, wherein the controller adjusts the feeding timing such that the conveying gap between the preceding recording sheet and the subsequent recording sheet, when the subsequent recording sheet is a thin recording sheet, is larger than the conveying gap between the preceding recording sheet and the subsequent recording sheet when the subsequent recording sheet is a thick recording sheet.

11. The image-forming device according to claim 9, wherein the controller adjusts the feeding timing such that the feeding timing is after a prescribed time has passed from the detected timing of the trailing end portion of the preceding recording sheet to control the conveying gap between the preceding recording sheet and the subsequent recording sheet, the prescribed time being determined based on the thickness of the preceding recording sheet.

12. The image-forming device according to claim 1, further comprising a memory that stores a table having relations between a thickness of recording sheet and a time interval, wherein the controller obtains the time interval corresponding to the preceding recording sheet by referring to the table and adjusts the feeding time such that the feeding timing is after the time interval has passed from the detected timing of the preceding recording sheet, to control the conveying gap between the preceding recording sheet and the subsequent recording sheet.

13. The control method according to claim 3, wherein the image-forming device includes a memory that stores a table having relations between a thickness of recording sheet and a time interval, wherein the adjusting step (e) refers to the time interval corresponding to the preceding recording sheet by referring to the table and adjusts the feeding timing such that the feeding timing is after the time interval has passed from the detected timing of the preceding recording sheet, to control the conveying gap between the preceding recording sheet and the subsequent recording sheet.

14. The image-forming device according to claim 9, further comprising a memory that stores a table having relations between a thickness of recording sheet and a time interval, wherein the controller obtains the time interval corresponding to the preceding recording sheet by referring to the table and adjusts the feeding timing such that the feeding timing is after the time interval has passed from the detected timing of the preceding recording sheet, to control the conveying gap between the preceding recording sheet and the subsequent recording sheet.

15. An image-forming device comprising:

a feeding member that feeds a recording sheet;

a conveying member that conveys the recording sheet fed by the feeding member;

an image-forming member that forms an image on the recording sheet conveyed by the conveying member;

a first detector that detects a trailing end portion of a preceding recording sheet conveyed by the conveying member and that provides a detected timing of the trailing end portion of the preceding recording sheet, the trailing end portion of the preceding recording sheet being one of a trailing edge of the preceding recording sheet and a curled end portion of the preceding recording sheet that is adjacent to the trailing edge;

a second detector that detects a thickness of the preceding recording sheet; and a controller that adjusts, when the conveying member conveys the preceding recording sheet and a subsequent recording sheet consecutively, a conveying gap between the preceding recording sheet and the subsequent recording sheet based on the thickness of the preceding recording sheet and the detected timing of the trailing end portion of the preceding recording sheet, wherein the second detector detects an elapsed time that is required for conveying the recording sheet for a predetermined section, the second detector determining that the recording sheet is a thick paper if the elapsed time exceeds a predetermined upper limit, the second detector determining that the recording sheet is a normal paper if the elapsed time is less than or equal to the predetermined upper limit and greater than or equal to a predetermined lower limit, the second detector determining that the recording sheet is a thin paper if the conveying time is less than the predetermined lower limit.

16. The image-forming device according to claim 1, wherein the detector is configured to detect the trailing end portion of the preceding recording sheet by touching one of the trailing edge of the preceding recording sheet and the curled end portion of the preceding recording sheet.

17. The image-forming device according to claim 9, wherein the first detector is configured to detect the trailing end portion of the preceding recording sheet by touching one of the trailing edge of the preceding recording sheet and the curled end portion of the preceding recording sheet.

* * * * *